US009493981B2

(12) United States Patent
Bishop et al.

(10) Patent No.: US 9,493,981 B2
(45) Date of Patent: Nov. 15, 2016

(54) SAFETY MECHANISM FOR A WINDOW COVERING

(75) Inventors: Ryan Barclay Bishop, Atlanta, GA (US); Juan Carlos Nava Campillo, Agua Prieta (MX); Patrick Foley, Winston-Salem, NC (US); Brian Douglas Furlong, Roswell, GA (US); JoAnn Whitney Hebner, Atlanta, GA (US); Russell Matoy, Atlanta, GA (US); Alejandro Rossato, Marietta, GA (US); Martin Richard Van Buren, Atlanta, GA (US)

(73) Assignee: Levolor, Inc., Atlanta, GA (US)

( * ) Notice: Subject to any disclaimer, the term of this patent is extended or adjusted under 35 U.S.C. 154(b) by 474 days.

(21) Appl. No.: 13/349,212

(22) Filed: Jan. 12, 2012

(65) Prior Publication Data

US 2012/0193043 A1 Aug. 2, 2012

Related U.S. Application Data

(63) Continuation-in-part of application No. 12/976,000, filed on Dec. 22, 2010.

(60) Provisional application No. 61/289,548, filed on Dec. 23, 2009, provisional application No. 61/432,003, filed on Jan. 12, 2011, provisional application No. 61/432,645, filed on Jan. 14, 2011.

(51) Int. Cl.

| | |
|---|---|
| ***A47H 5/00*** | (2006.01) |
| ***E06B 3/32*** | (2006.01) |
| ***E06B 9/08*** | (2006.01) |

(Continued)

(52) U.S. Cl.
CPC ..... *E06B 9/262* (2013.01); *E06B 2009/2622* (2013.01)

(58) Field of Classification Search
CPC ..... E06B 9/262; E06B 2009/2622; E06B 2009/2625; E06B 2009/2627
USPC ..... 160/178, 1 R, 84.04, 84.01, 330, 340, 160/173 R, 84.03, 84.05, 168.1 R, 87, 89
See application file for complete search history.

(56) References Cited

U.S. PATENT DOCUMENTS

| | | | | |
|---|---|---|---|---|
| 1,301,603 | A | 4/1919 | Rathbun | |
| 2,631,661 | A | 3/1953 | Nelson | |
| 3,160,202 | A * | 12/1964 | Rosen | 160/344 |

(Continued)

FOREIGN PATENT DOCUMENTS

| | | |
|---|---|---|
| WO | 0236922 A1 | 5/2002 |

OTHER PUBLICATIONS

Mexican Patent Office, Office Action, Patent Application No. MX/a/2007/013429, Feb. 24, 2011.

(Continued)

*Primary Examiner* — Katherine Mitchell
*Assistant Examiner* — Jeremy Ramsey
(74) *Attorney, Agent, or Firm* — Dority & Manning, P.A.

(57) ABSTRACT

A safety device for a window covering comprises a head rail and a shade panel extending from the head rail. A lift cord extends along one side of the shade panel between the head rail and the bottom of the shade panel. A safety device engages the lift cord to control the movement of the lift cord away from the shade panel. The safety device may also shroud the lift cord to limit access to the lift cord portion.

10 Claims, 17 Drawing Sheets

(51) Int. Cl.
*E06B 3/48* (2006.01)
*E06B 9/262* (2006.01)

(56) References Cited

U.S. PATENT DOCUMENTS

| | | | | |
|---|---|---|---|---|
| 3,246,685 | A | 4/1966 | Anderson et al. | |
| 4,202,395 | A | 5/1980 | Heck et al. | |
| 4,603,725 | A | 8/1986 | Knight | |
| 4,846,243 | A | 7/1989 | Schneider | |
| 4,880,044 | A | 11/1989 | Judkins | |
| 4,909,298 | A | 3/1990 | Langhart et al. | |
| 5,090,466 | A * | 2/1992 | Hong | 160/84.04 |
| 5,104,469 | A | 4/1992 | Colson | |
| 5,129,440 | A | 7/1992 | Colson | |
| 5,195,335 | A | 3/1993 | Hart | |
| 5,279,473 | A | 1/1994 | Rozon | |
| 5,425,408 | A | 6/1995 | Colson | |
| 5,473,797 | A | 12/1995 | Wu | |
| 5,485,875 | A | 1/1996 | Genova | |
| 5,494,092 | A | 2/1996 | Georgopoulos | |
| 5,504,977 | A | 4/1996 | Weppner et al. | |
| 5,518,056 | A | 5/1996 | Voss | |
| 5,518,057 | A | 5/1996 | Huang | |
| 5,542,461 | A | 8/1996 | Huang | |
| 5,542,462 | A | 8/1996 | Elsenheimer et al. | |
| 5,553,650 | A | 9/1996 | Jelic | |
| 5,553,653 | A | 9/1996 | Rozon | |
| 5,560,414 | A | 10/1996 | Judkins et al. | |
| 5,562,140 | A | 10/1996 | Biba | |
| 5,577,543 | A | 11/1996 | Jelic | |
| 5,579,819 | A | 12/1996 | Hung et al. | |
| 5,592,983 | A | 1/1997 | Sartini et al. | |
| 5,630,458 | A | 5/1997 | Holden | |
| 5,634,244 | A | 6/1997 | Fetsch et al. | |
| 5,715,884 | A | 2/1998 | Cotten | |
| 5,722,478 | A | 3/1998 | Claypool et al. | |
| 5,823,242 | A | 10/1998 | Huang | |
| 5,906,233 | A | 5/1999 | May | |
| 5,908,063 | A | 6/1999 | Gobidas | |
| 6,044,523 | A | 4/2000 | Ortega | |
| 6,116,325 | A | 9/2000 | Colson et al. | |
| D440,094 | S | 4/2001 | Shen | |
| 6,263,946 | B1 | 7/2001 | Cotten | |
| 6,431,248 | B1 | 8/2002 | Hyman et al. | |
| 6,502,619 | B1 * | 1/2003 | Kraeutler | 160/84.01 |
| 6,585,026 | B2 | 7/2003 | Su et al. | |
| 6,644,379 | B1 | 11/2003 | Nei | |
| 6,749,000 | B2 | 6/2004 | Bohlen | |
| 6,767,615 | B1 | 7/2004 | Judkins et al. | |
| 6,792,995 | B2 | 9/2004 | Judkins | |
| 6,792,997 | B2 | 9/2004 | Damiano | |
| 6,845,803 | B1 | 1/2005 | Nien | |
| 6,860,312 | B2 | 3/2005 | Judkins | |
| 6,908,661 | B2 | 6/2005 | Green et al. | |
| 6,932,140 | B2 | 8/2005 | Ni | |
| 6,971,434 | B2 | 12/2005 | Nien | |
| 6,994,143 | B2 | 2/2006 | McCarty et al. | |
| 7,017,230 | B2 | 3/2006 | Lin | |
| 7,086,446 | B2 | 8/2006 | Kollman et al. | |
| 7,318,251 | B2 | 1/2008 | Lin | |
| 7,325,279 | B2 | 2/2008 | Huang | |
| 7,654,299 | B2 | 2/2010 | LeBlanc et al. | |
| 8,079,397 | B2 * | 12/2011 | Robertson | 160/84.05 |
| 2003/0062137 | A1 | 4/2003 | Su et al. | |
| 2003/0150567 | A1 | 8/2003 | Hyman et al. | |
| 2004/0060670 | A1 | 4/2004 | Judkins | |
| 2004/0089428 | A1 | 5/2004 | Judkins | |
| 2004/0182523 | A1 | 9/2004 | McCarty et al. | |
| 2004/0226137 | A1 | 11/2004 | Lin | |
| 2005/0022948 | A1 | 2/2005 | Nien | |
| 2005/0056385 | A1 | 3/2005 | Dekker | |
| 2005/0082019 | A1 | 4/2005 | Nien | |
| 2005/0087312 | A1 | 4/2005 | Nien | |
| 2005/0092446 | A1 | 5/2005 | Ni | |
| 2005/0092448 | A1 * | 5/2005 | Lin | 160/291 |
| 2005/0115683 | A1 | 6/2005 | Ng et al. | |
| 2005/0115684 | A1 | 6/2005 | Judkins et al. | |
| 2005/0257900 | A1 | 11/2005 | McCarty et al. | |
| 2005/0257902 | A1 | 11/2005 | Pernicano | |
| 2006/0060308 | A1 | 3/2006 | LeBlanc et al. | |
| 2006/0144526 | A1 | 7/2006 | McGinley | |
| 2006/0157204 | A1 * | 7/2006 | Lin | E06B 9/262 160/84.04 |
| 2007/0163728 | A1 | 7/2007 | Nien | |
| 2008/0099165 | A1 | 5/2008 | Birch | |
| 2008/0110581 | A1 | 5/2008 | Lin | |
| 2009/0101290 | A1 | 4/2009 | Lin | |
| 2009/0266496 | A1 * | 10/2009 | Dann et al. | 160/84.05 |
| 2010/0126675 | A1 | 5/2010 | Jelic et al. | |
| 2010/0126678 | A1 | 5/2010 | Lin | |
| 2011/0024065 | A1 * | 2/2011 | Lin | E06B 9/262 160/340 |
| 2011/0132555 | A1 * | 6/2011 | Rowley et al. | 160/340 |
| 2011/0186242 | A1 | 8/2011 | Foley et al. | |
| 2011/0203079 | A1 * | 8/2011 | Anthony et al. | 24/115 F |
| 2011/0220301 | A1 * | 9/2011 | Lin | 160/84.04 |
| 2011/0308742 | A1 * | 12/2011 | LeBlanc | 160/84.04 |
| 2012/0018108 | A1 * | 1/2012 | Lin | 160/340 |
| 2012/0227910 | A1 * | 9/2012 | Lin | 160/84.01 |
| 2013/0126105 | A1 | 5/2013 | Lin | |

OTHER PUBLICATIONS

Newell Window Furnishings, Inc., Chinese Application No. 201110434933.8, Office Action, Nov. 15, 2013.

Newell Window Furnishings, Inc., Canadian Application No. 2,800,711, Office Action, Jan. 29, 2014.

Newell Window Furnishings, Inc., Canadian Application No. 2,800,711, Office Action, Oct. 17, 2014.

* cited by examiner

SAFETY MECHANISM FOR A WINDOW COVERING

This application is a continuation-in-part of copending U.S. patent application Ser. No. 12/976,000 filed on Dec. 22, 2010 which claims the benefit of U.S. Provisional Application No. 61/289,548, filed on Dec. 23, 2009, which is incorporated herein by reference in its entirety; this application claims benefit of priority under 35 U.S.C. §119(e) to the filing date of to U.S. Provisional Application No. 61/432,003, as filed on Jan. 12, 2011 which is incorporated herein by reference in its entirety, and U.S. Provisional Application No. 61/432,645, as filed on Jan. 14, 2011 which is incorporated herein by reference in its entirety.

The safety device described herein is suitable for use with Roman shades although it may have use on a variety of window coverings.

BACKGROUND OF THE INVENTION

Window coverings such as shades and blinds are known that use pull cords to raise and lower and otherwise manipulate the shade panel. The pull cords may be exposed where they may present an entanglement hazard. One such window covering is commonly referred to as a Roman shade. A typical Roman shade comprises a head rail from which a flexible shade panel is suspended. The shade panel may be divided into a plurality of panels that are connected to one another at horizontal joints or seams. A plurality of lift cords may be provided that have a first end that can be manipulated by a user to raise or lower the shade panel. The lift cords extend to the head rail and down the back of the shade panel where the second ends of the cords are connected to the bottom edge of the shade panel or to a bottom rail that is connected to the bottom edge of the shade panel. The cords may pass through eyelets or rings that are positioned at the joints or seams in part to provide a desired fold pattern in the shade panel. The lift cords may be pulled to raise the shade panel and released to lower the shade panel.

SUMMARY OF THE INVENTION

A window covering comprises a head rail. A shade panel extends from the head rail. A lift cord extends between the head rail and the shade panel for raising the shade panel. A safety ribbon is permanently attached to the shade panel. The safety ribbon covers the lift cord such that the lift cord is trapped between the safety ribbon and the shade panel.

The safety ribbon may be attached to the shade panel by at least one of: (a) stitching or (b) adhesive.

A window covering comprises a head rail. A shade panel extends from the head rail. A lift cord extends from the head rail to the shade panel for raising the shade panel. A safety shroud, where the lift cord extends at least partially through the safety shroud and the safety shroud at least partially surrounds the lift cord. The safety shroud is connected to the shade panel at a plurality of points.

The safety shroud may be operably connected to the shade panel. The shade panel may be configured to form a plurality of horizontal folds and the safety shroud may be connected directly to the shade panel proximate to at least a portion of the plurality of horizontal folds. The safety shroud may be operably connected to the shade panel by a plurality of rings. At least a portion of the plurality of rings may extend through the safety shroud and receive the lift cord. The safety shroud may be operably connected to the shade panel by at least one of: adhesive, stitching, welding, stapling, hook and loop fastener, clip, batten bar, magnet, mechanical fastener, or chemical adhesion. The shade panel may be divided into a plurality of panels operably connected to one another at a plurality of horizontal joints and the safety shroud may be operably attached to the shade panel at at least a portion of the plurality of horizontal points. The safety shroud may comprise a safety cord having a plurality of cord restraints extending therefrom where the lift cord extends at least partially through the plurality of cord restraints. The safety cord may be operably connected to the shade panel at a plurality of points. The safety shroud may comprise a cellular shade structure where the lift cord extends at least partially through the cellular shade structure. The cellular shade structure may be operably connected to the shade panel at a plurality of points. The safety shroud may comprise a collapsible tube where the lift cord extends at least partially through the collapsible tube. The collapsible tube may be operably connected to the shade panel at a plurality of points. The safety shroud may comprise a safety ribbon operably attached to the shade panel where the safety ribbon substantially covers the lift cord such that the lift cord is trapped between the safety ribbon and the shade panel along at least a portion of the length of the lift cord. The safety shroud may comprise a back panel comprising a front encasing panel and a back encasing panel, where at least a portion of the lift cord extends along at least a partial length of the shade panel and between the front encasing panel and back encasing panel. The front encasing panel and back encasing panel may be secured together along at least a portion of the length of both sides. The back panel may extend substantially the width of the shade panel. The back panel may covering at least a portion of a back side of the shade panel and the safety shroud may be positioned between back panel and the shade panel along the length of the back panel.

A window covering comprises a head rail. The shade panel extends from the head rail. A lift cord extends between the head rail and the shade panel for raising the shade panel. A back panel comprises a front encasing panel and a back encasing panel defining an interior therein, wherein at least a portion of the lift cord extends along at least a partial length of the shade panel through the interior defined between the front encasing panel and back encasing panel, and the back panel is operably connected to the shade panel at a plurality of points.

The back panel may be operably connected to the shade panel at the plurality of points by a plurality of rings. At least a portion of the plurality of rings may extend through the front encasing panel and into the interior where the lift cord extends through the at least a portion of the plurality of rings. At least one of the front encasing panel or the back encasing panel may comprise an interior facing cord guide where the lift cord extends through the interior facing cord guides. The window covering of claim 18, wherein the lift cord comprises a first lift cord and a second lift cord, and wherein both the first lift cord and the second lift cord extend along at least a partial length of the shade panel and through the interior defined between the front encasing panel and back encasing panel.

A window covering comprises a head rail. A shade panel extends for a length from the head rail. A lift cord extends between the head rail and the shade panel for raising the shade panel. A back panel covers at least a portion of a back side of the shade panel. The lift cord is positioned between back panel and the shade panel along at least the partial length of the back panel.

The lift cord may extend at least partially through a safety shroud. The safety shroud may be operably connected to the shade panel at a plurality of points along the length of the shade panel and positioned between the back panel and the shade panel along at least a partial length of the back panel. The safety shroud may comprise at least one of: (a) a safety cord and a plurality of cord restraints where the lift cord extends through the plurality of cord restraints; (b) a cellular shade structure where the lift cord extends through the cellular shade structure; (c) a collapsible tube where the lift cord extends through the collapsible tube; or (d) a safety ribbon operably attached to the shade panel, said safety ribbon covering the lift cord such that the lift cord is trapped between the safety ribbon and the shade panel along at least a portion of the length of the lift cord. The back panel may comprise a front encasing panel and a back encasing panel defining an interior therein where at least a portion of the lift cord extends along at least a partial length of the shade panel through the interior defined between the front encasing panel and back encasing panel. The back panel may be operably connected to the shade panel at a plurality of points along the back panel.

DETAILED DESCRIPTION OF PREFERRED EMBODIMENTS OF THE INVENTION

Embodiments of the invention comprise a shroud that at least partially covers the lift cords of a window covering. The shroud may completely isolate the lift cords to completely prevent access to the lift cords by a user or the shroud may partially cover the lift cords to limit access to the lift cords by a user. The shroud may have a variety of configurations and structures provided that the shroud is capable of isolating the lift cord and/or limiting or controlling the movement of the lift cord.

Figure 1:
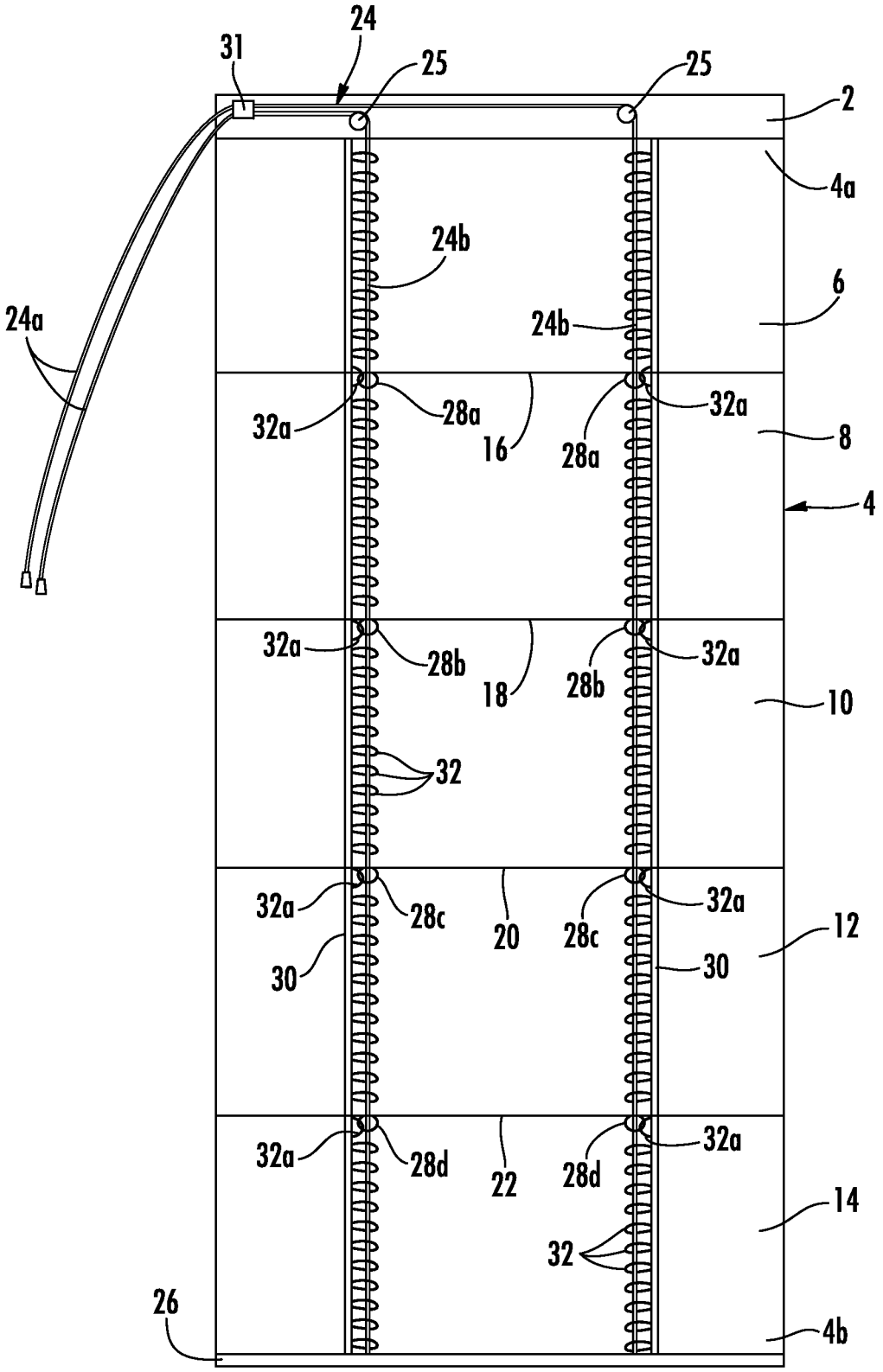
FIG. 1 is a back view of a window covering and an embodiment of the safety mechanism of the invention.
Figure 2:
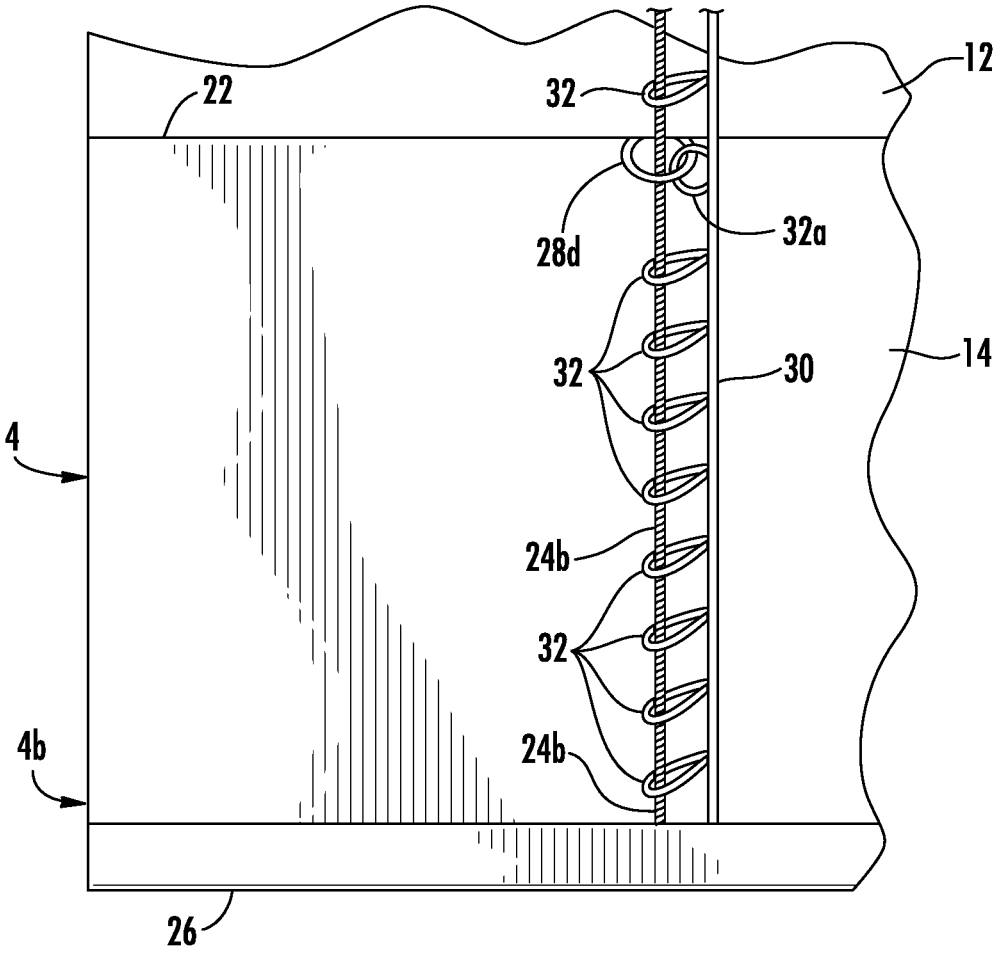
FIG. 2 is a more detailed back view illustrating the safety mechanism of FIG. 1.

The safety mechanism of the invention may be used on window coverings having exposed lift cords. One such window covering with which the safety mechanism has particular applicability is known as a Roman shade. An example embodiment of a Roman shade is shown in FIGS. 1 and 2. A typical Roman shade comprises a head rail 2 from which a flexible shade 4 is suspended. The head rail 2 may be constructed of wood, steel or other rigid material and may be solid or have an interior channel. It is appreciated that, in some embodiments, the term "head rail" need not be limited to a traditional head rail structure and may include any structure, component or components from which a shade may be suspended or supported and which may include operating systems and/or shade control components. The head rail 2 may be mounted to a window or other architectural feature by brackets or other mounting mechanism. The flexible shade panel 4 has a top edge 4*a* that is located adjacent to and may be connected to head rail 2 and a bottom edge 4*b* that is suspended remotely from the head rail 2.

The flexible shade panel 4 may be made from a wide variety of suitable materials and designs such as woven or non-woven fabric, natural materials such as wood, bamboo, faux wood or the like. The shade panel 4 is divided into a plurality of panels 6, 8, 10, 12 and 14 connected to one another at horizontal joints or seams 16, 18, 20 and 22. The joints or seams may be formed by sewn seams that connect the adjacent panels, fold lines, separate metal or plastic elements such as batten bars or the like. In some embodiments the shade panel 4 may be formed of a single panel that is adapted to fold at a plurality of folds or of a plurality of separate panels connected together at the joints or seams.

A plurality of lift cords 24 are provided that have a first exposed portion 24*a* that form exposed pull cords that may be manipulated by the user to raise or lower the shade panel 4. The lift cords 24 extend to the head rail 2 and down the back side of the shade panel 4 and are connected near or at the bottom edge 4*b* of the shade panel 4 or to a bottom rail 26 to form lift cord portions 24*b*. In the illustrated embodiment the pull cord portions 24*a* and the lift cord portions 24*b* are formed of a single cord; however, these elements may be made of different elements that are operatively connected to one another. The lift cords 24 may extend through the hollow interior of the head rail 2 or along the back side of the head rail 2 where they are hidden from view from the front of the window covering. The lift cords 24 may also be guided and controlled along the head rail 2 by other cord control mechanisms 25 such as pulleys, drums, guides or the like. The lift cords 24 may pass through eyelets or rings 28*a*, 28*b*, 28*c* and 28*d* that are positioned at the joints 16, 18, 20 and 22, respectively. A fewer or greater number of panels, joints and rings may be provided. In some shade designs the rings 28*a*-28*d* comprise metal, fabric or plastic loops that are sewn or otherwise connected to the shade. In other designs where a metal or plastic extrusion forms the joints 16, 18, 20 and 22 and the rings 28*a*-28*d* may snap or slide into engagement with the metal or plastic extrusion.

Figure 5:
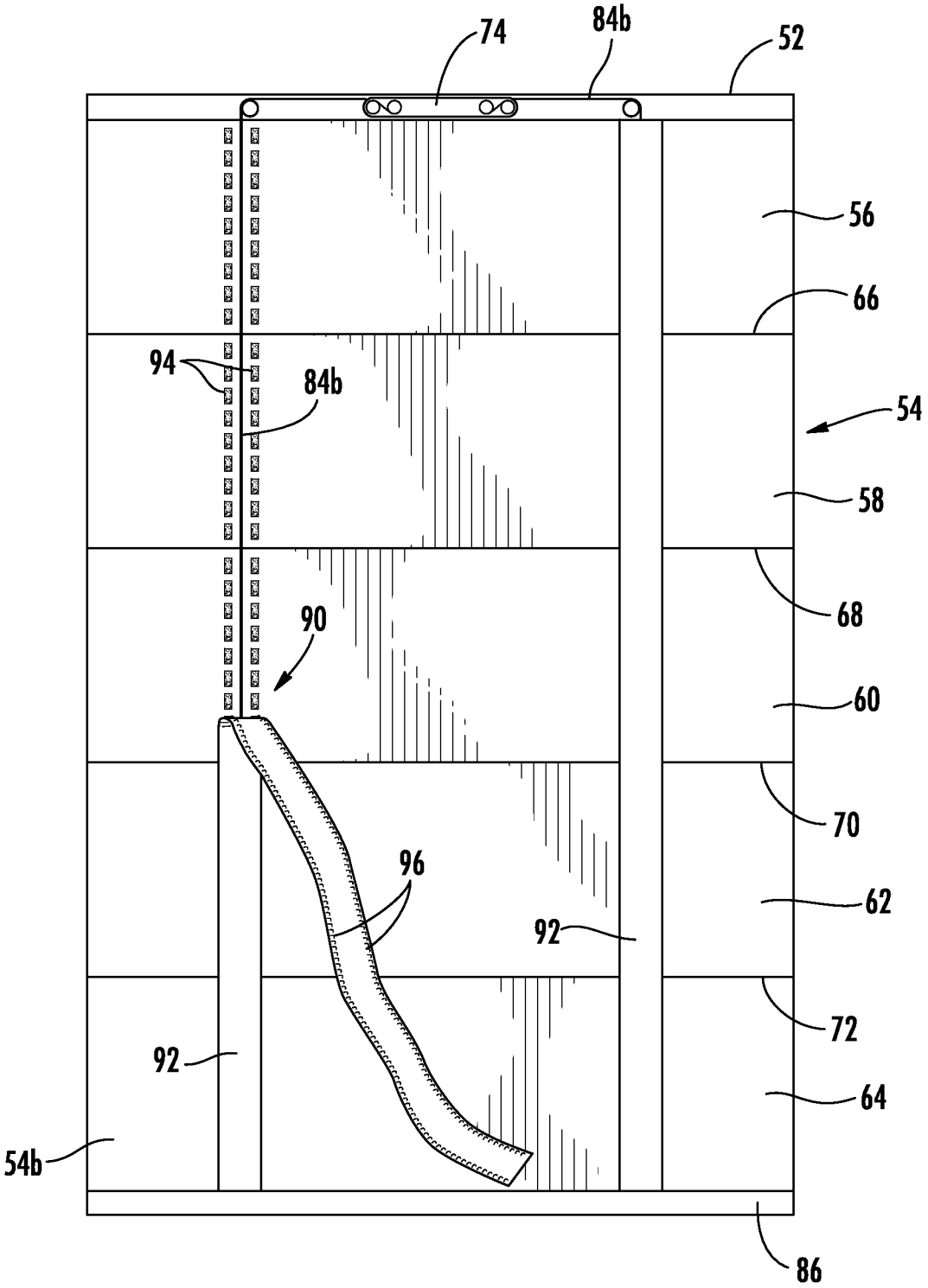
FIG. 5 is a back view of a window covering and another embodiment of the safety mechanism of the invention.
Figure 6:
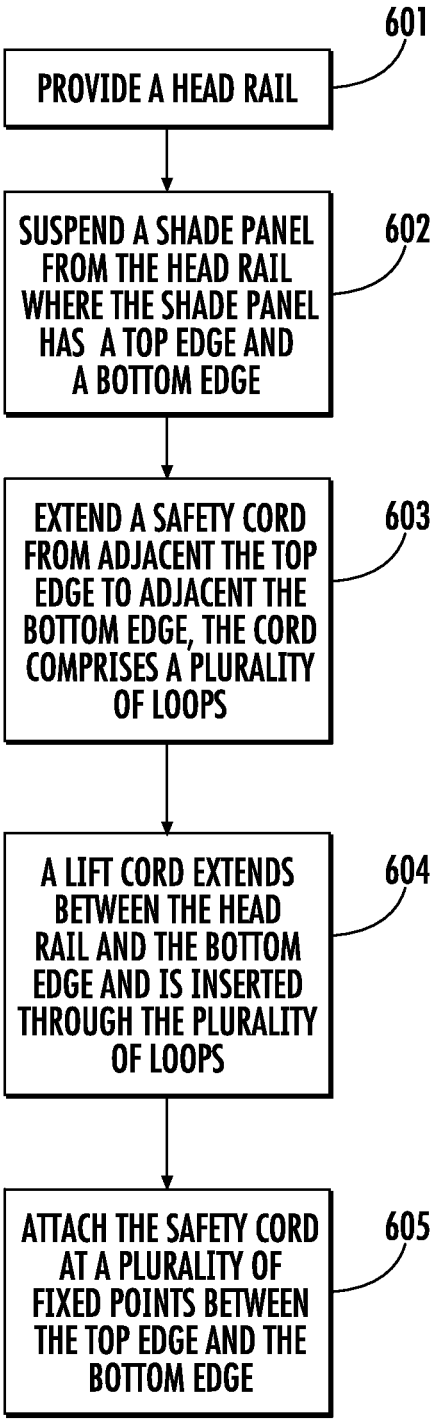
FIG. 6 is a block diagram illustrating a method of making a window covering.
Figure 8:
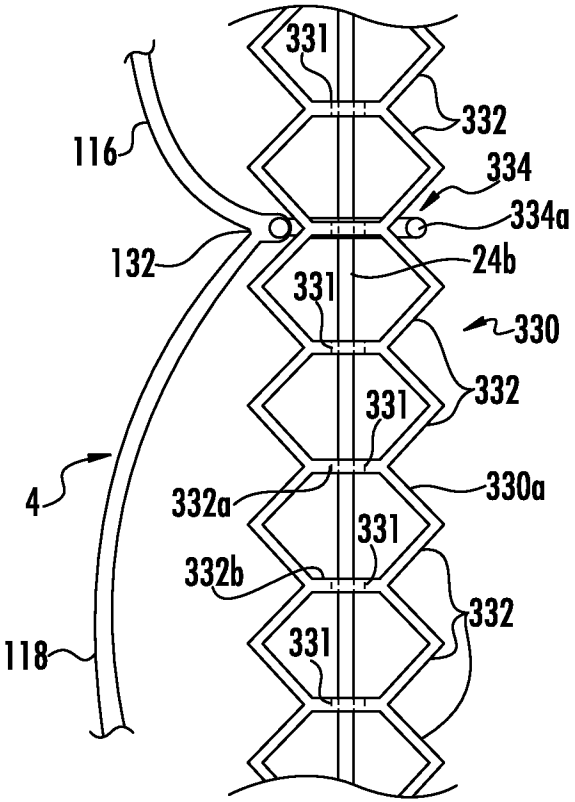
FIG. 8 is a detailed partial side view of the embodiment of FIG. 7 in a lowered position.

When a user pulls on the pull cord portions 24*a* of the lift cords 24, the lift cord portions 24*b* raise the bottom edge 4*b* of the shade panel and bottom rail 26. The bottom edge 4*b* of the shade 4 rises until it contacts the first set of rings 28*d* disposed at the first joint 22. At this point the first panel 14, between the bottom edge 4*b* of the shade panel 4 and the first joint 22, is folded. As the lift cords 24 are raised further the bottom edge 4*b* of the shade panel 4, because of its contact with the first set of rings 28*d* disposed along joint 22, raises the first joint 22 until the bottom of the second panel 12 engages the second set of rings 28*c* disposed along the second joint 20. At this point the first panel 14 and second panel 12 are both raised and are both folded. The first panel 14 is folded between the bottom edge 4*b* of the panel and the first joint 22 and the second panel 12 is folded between the first joint 22 and the second joint 20. This process may continue until the shade panel 4 is completely raised and all of the panels 6, 8, 10, 12 and 14 are folded. A cord lock 31 may be provided to hold the lift cords 24 to maintain the shade panel 4 in any raised position. The lift cords 24 may also be tied off to a cleat to hold the shade panel 4 in a raised position. Further, a lift motor such as a spring motor may be located in the head rail for holding the shade 4 in a raised position where the lift cord portions 24*b* are connected to the spring motor and the pull cord portions 24*a* are eliminated, as shown in FIG. 5. The lift cords 24 may be released such that the bottom edge 4*b* of the shade panel 4 is lowered and the panels 6, 8, 10, 12 and 14 are unfolded. The shade panel 4 may assume and be held in any position between the fully raised and lowered positions.

The lift cords 24 are exposed on the back side of the shade panel 4 such that a person or article may become entangled in or caught on the lift cord portions 24*b*. Because each cord 24 passes through a series of rings 28*a*-28*d*, a person or article may become entangled or trapped in any loop created by the cord 24, shade panel 4 and the rings 28.

To minimize the chances that a person or article may become entangled in the lift cord portions 24*b*, a safety mechanism is provided. In one embodiment the safety mechanism comprises a safety cord 30 that runs parallel to each lift cord portion 24*b*. The safety cord 30 may extend from adjacent the head rail 2 to adjacent the bottom edge 4*b* of the shade panel 4. One end of the safety cord 30 may be fixed to the head rail 2 or to the top 4*a* of shade panel 4 and the opposite end of the safety cord 30 may be fixed to the bottom rail 26 or at or near the bottom edge 4*b* of shade panel 4. The ends of the safety cord 30 may be spaced from both the head rail 2 and the distal ends of the lift cord portions 24*b* a selected distance such that the safety cord 30 is slightly shorter than the lift cord portions 24*b* and the shade panel 4. In such an arrangement a relatively small length of each end of the lift cord portions 24*b* is not engaged by the safety cord 30. The length of each end of the lift cord portion 24*b* that is left unsecured by the safety cord 30 is preferably selected such that it is too short to present a hazard. In other embodiments, the lift cord portions 24*b* may attach at or near the lower joint, such as near the lowest joint 22, which allows panels 6, 8, 10 and 12 to fold during retraction but panel 14 to remain unfolded at the bottom of the shade panel 4 such as for aesthetic purposes. In this embodiment the safety cord 30 may extend as far as the lift cord portion 24*b* attachment point at or near the lower joint (e.g., the joint 22) engaging substantially all of the lift cord portion 24*b*; though, in other embodiments, the safety cord 30 may be even shorter than the lift cord portion 24*b* as previously described. The safety cord 30 comprises a cord, ribbon or the like having a series of loops, cord engaging elements or other cord restraints 32 provided along the length thereof. The loops or cord restraints 32 are relatively closely spaced. For example, according to one embodiment, there is approximately one inch between adjacent loops 32. In other embodiments, the spacing between the loops may be greater or less. For example, the spacing between the loops 32 may be as great as the approximate height between the joints or seams, which may be, for example, up to approximately 9 inches, or even greater in some embodiments. Moreover, the distance between the loops may vary along the length of the safety cord such that the loops are not equally spaced along the length of the safety cord. The safety cord 30 and the cord restraints 32 may have a variety of configurations. The safety cord may comprise any flexible member having cord restraints or loops formed integrally with the flexible member or attached as separate components to the flexible member. For example, the safety cord may have a ladder-type configuration where the lift cord is inserted through the spaces or loops formed by the steps of the ladder or the safety cord may comprise a length of cellular shade structure as shown and described with respect to FIG. 7. The safety cord may also comprise a flexible member having separate rings, bands or the like attached thereto. The attached rings or bands may be made of a rigid material such as metal or plastic or may be formed of a flexible material such as cord, fabric, elastomer or the like. One loop 32*a* is connected to each of the rings 28*a*-28*d* such that the safety cord 30 is fixed in position relative to the shade panel 4. The points where the safety cord 30 is fixed in position, either by attachment to rings 28*a*-28*d*, the bottom edge 4*b* or top edge 4*a* of the shade panel, or the head rail 2 or bottom rail 26, are referred to herein as fixed points. The safety cord 30 has a length and the loops 32 are positioned such that the safety cord 30 just spans the distance between adjacent fixed points with minimum clearance when the shade panel 4 is in the fully extended or lowered position. In other words the length of the safety cord 30 between any two adjacent fixed points is substantially equal to the distance between the fixed points when the shade panel is fully extended. Each lift cord portion 24*b* extends through the loops 32 such that the lift cord 24 may move relative to the safety cord 30 when the shade is raised and lowered. One purpose of the engagement between the safety cord and the lift cord and the attachment of the safety cord to the shade panel 4 at fixed points is to reduce the size of the possible loop that may be formed and to increase friction when the lift cord is pulled.

Figure 3:
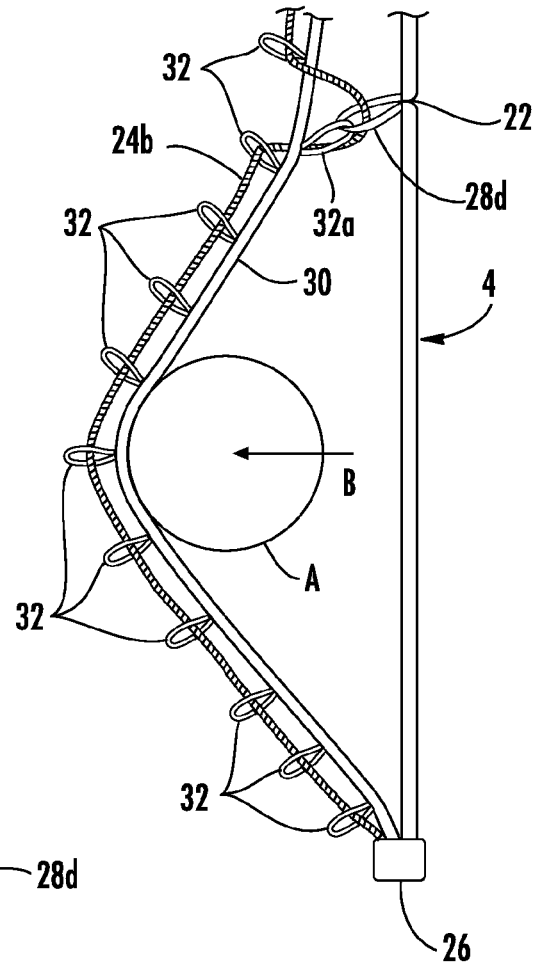
FIGS. 3 and 4 illustrate the operation of the safety mechanism of FIG. 1.

FIG. 3 shows the window covering when a force B is exerted by a person or article A on the lift cord portions 24*b* and safety cord 30 tending to pull the lift cord and safety cord away from the shade panel 4. The safety cord 30 prevents the lift cord from being extended away from the shade panel in the direction of arrow B beyond a limited distance as limited by the length of the safety cord 30 between the two adjacent fixed points (as shown, the fixed points are the bottom rail 26 and ring 28*d*). The safety cord 30 limits the space between the lift cord/safety cord and the shade panel 4 to an acceptably safe distance. This space can be made smaller by making the distance between the fixed points shorter as desired. This situation is also true if a force is applied only to the safety cord 30.

Figure 4:
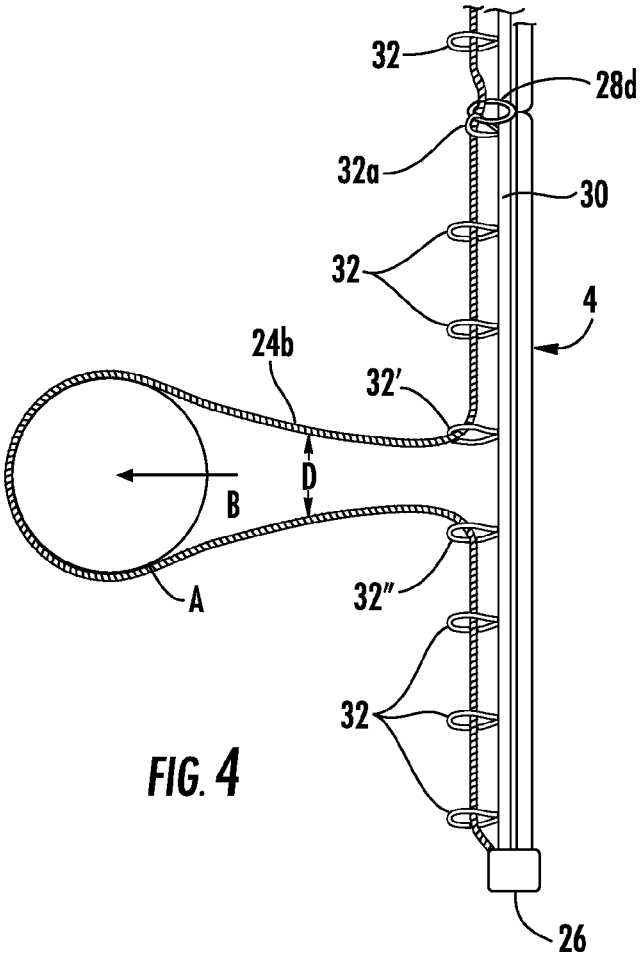

FIG. 4 shows the window covering when a force is exerted only on the lift cord portions 24*b* (and not on safety cord 30) by a person or article A tending to pull the lift cord away from shade panel 4. The lift cord portion 24*b* may be pulled from between two adjacent loops 32' and 32" in the direction of arrow B as shown. However, because the adjacent loops 32' and 32" are spaced closely together, the portion of the lift cord 24 that is pulled through the safety cord is constrained to have a very narrow profile D. The distance D between the portions of the lift cord that are pulled from the safety cord is acceptably small such that risk of accidental entanglement inside of the loop created by lift cord 24 is minimized. Further, the close spacing between the adjacent loops 32 makes access to the lift cord 24 difficult such that it is practically difficult for the situation illustrated in FIG. 4 to accidentally occur. The distance between adjacent loops 32 can be shortened to less than 1 inch to make the distance D even narrower if desired.

As previously described, the safety cord may comprise any flexible member having cord engaging elements, cord restraints or loops formed integrally with the flexible member or attached as separate components to the flexible member. For example, the safety cord may have a ladder-type configuration where the lift cord is inserted through the spaces or loops formed by the steps of the ladder or the safety cord may comprise a length of cellular shade structure as shown and described with respect to FIG. 7. The safety cord may also comprise a flexible member having separate rings, bands or the like attached thereto. The attached rings or bands may be made of a rigid material such as metal or plastic that reduce friction or may be formed of a flexible material such as cord, fabric, elastomer or the like. The safety cord 30 may be a fabric tape or a band of fabric rather than a cord. The term "safety cord" as used herein means any flexible elongated member having a plurality of closely spaced loops attached or formed along the length thereof including cord, ribbon, fabric bands or the like having either integrally formed loops or attached rings or other cord engaging elements or restraints. The safety cord loops 32 may be made smaller than the attachment loops 32*a*. This is different than hobble cords that are used to set the length or look of the shade because the safety cord 30 is used as a safety device. The loops 32 may be cord or metal/plastic ring and the attachment loops 32*a* may be specially designed to incorporate attachment mechanisms to attach directly to the face fabric of shade panel 4 or to extrusions forming seams 16, 18, 20 and 22 (rather than to rings 28*a*-28*d*) and may, for example, be insert molded. The safety cords 30 may be made where the attachment loops 32*a* feature a built in release device to allow larger panel widths (i.e. larger distances between adjacent seams).

Figure 7:
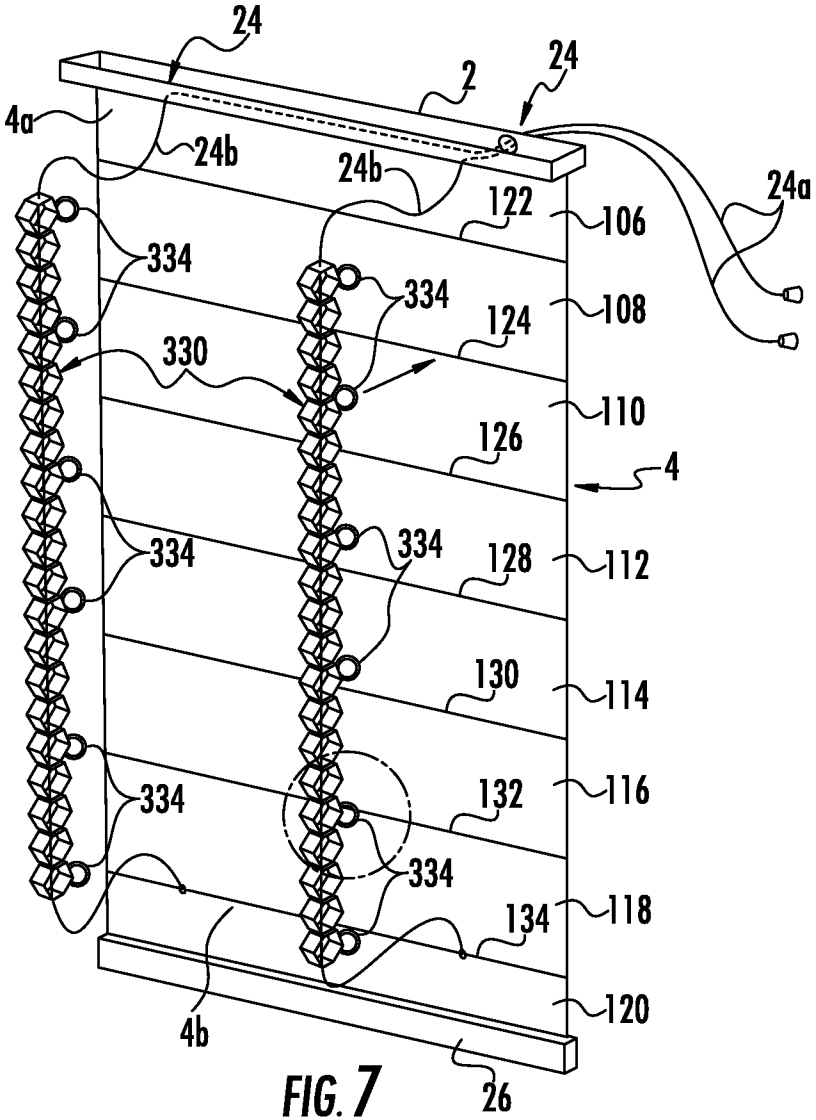
FIG. 7 is a partially exploded back perspective view of a window covering and an embodiment of the safety mechanism of the invention.

An alternate embodiment of a safety mechanism is shown in FIGS. 7 through 10 where like reference numerals are used to identify like components previously described with reference to the embodiment of FIGS. 1 through 4. The window covering comprises a head rail 2 supporting a flexible shade panel 4 that is divided into a plurality of panels 106, 108, 110, 112, 114, 116, 118 and 120 connected to one another at a horizontal joints or seams 122, 124, 126, 128, 130, 132 and 134. In some embodiments the shade panel 4 may be formed of a single panel that is adapted to fold at a plurality of folds or of a plurality of separate panels connected together at the joints or seams as previously described. The joints or seams may be formed by sewn seams between adjacent panels, fold lines, separate metal or plastic hinge elements such as batten bars or the like. The lift cord portions 24*b* are operatively connected to the pull cord portions 24*a* and the distal ends of the lift cord portions 24*b* are connected to the bottom rail 26 or near or to a bottom edge 4*b* of shade panel 4, such as at the lowest joint or seam 134 as shown in FIG. 7. The shade panel 4 may be raised and lowered using the pull cords 24*a* as described with reference to FIG. 1. Alternatively, a lift motor 74 such as a spring motor may be located on the head rail 2 for holding the shade 4 in a raised position where the lift cord portions 24*b* are connected from the spring motor 74 to the bottom rail 26 or near or to a bottom edge 4*b* of shade panel 4 as shown in FIG. 5.

A safety cord 330 runs along the length of each lift cord portion 24*b* that may be used in place of the looped safety cord 30 of the embodiment of FIG. 1. The safety cord 330 may extend from adjacent the head rail 2 to adjacent the bottom edge 4*b* of the shade panel 4 or the bottom rail 26. One end of the safety cord 330 may be fixed to the head rail 2 or the top 4*a* of shade panel 4 and the opposite end of the safety cord 330 is fixed to the bottom rail 26 or at or near the bottom edge 4*b* of shade panel 4. The ends of the safety cord 330 may be spaced from the head rail 2 and the distal ends of the lift cord portions 24*b* a selected distance such that the safety cord is slightly shorter than the lift cord portions 24*b* and the shade panel 4. In such an arrangement a relatively small length of the lift cord portions 24*b* is not engaged by the safety cord 330. The length of each end of the lift cord portion 24*b* that is left unsecured by the safety cord 330 is preferably selected such that it is too short to present a hazard.

The safety cord 330 comprises length of cellular shade structure 330*a* having a series of cells 332 provided along the length thereof. The cells 332 are relatively small and closely spaced, for example, in one embodiment the top wall 332*a* may be spaced approximately one inch from the bottom wall 332*b* of the cell, although it is to be understood that the cells may be configured in a variety of sizes and is not limited to the preferred embodiment. The lift cord portions 24*b* pass through apertures 331 in the top and bottom walls of the cells 332 such that the lift cord portion 24*b* is retained within the cellular shade structure but is free to move relative to the cell structure through the apertures 331 during operation of the window covering. The cellular shade structure is arranged such that the fold lines of the cellular shade structure extend transversely to lift cord portions 24*b* such that the cellular shade structure may collapse and expand when the shade is raised and lowered. As a result, the top and bottom walls of the cells 332 act like the cord engaging elements, restraints or loops 32 of the embodiment of FIGS. 1 through 4 to trap the lift cord portion 24*b* and to increase the amount of friction exerted on the lift cord portion 24*b* to further restrict the forming of larger loops in the lift cord portions 24*b*. The safety cord 330 is attached to the shade panel 4 at fixed points as will hereinafter be described such that the safety cord limits the distance the lift cord may be pulled from the shade panel 4 as shown and described previously with reference to FIG. 3. Further, the amount of lift cord 24 that may be pulled through the safety cord 330 is limited and the size of a loop that may be created is narrow as shown and described previously with respect to FIG. 4. The cellular shade structure 330*a* forms a shroud around the lift cord portion 24*b* that limits access to the lift cord portion. The use of a cellular shade structure makes it more difficult for a person to access the lift cord 24*b* because the lift cord may only be accessed through the open side of the cells 332. The open sides of the cells 332 may be closed using fabric or other compressible material to completely isolate the lift cords 24*b* from the user such that the safety cord 330 completely shrouds the lift cord portion 24*b*.

Figure 12:
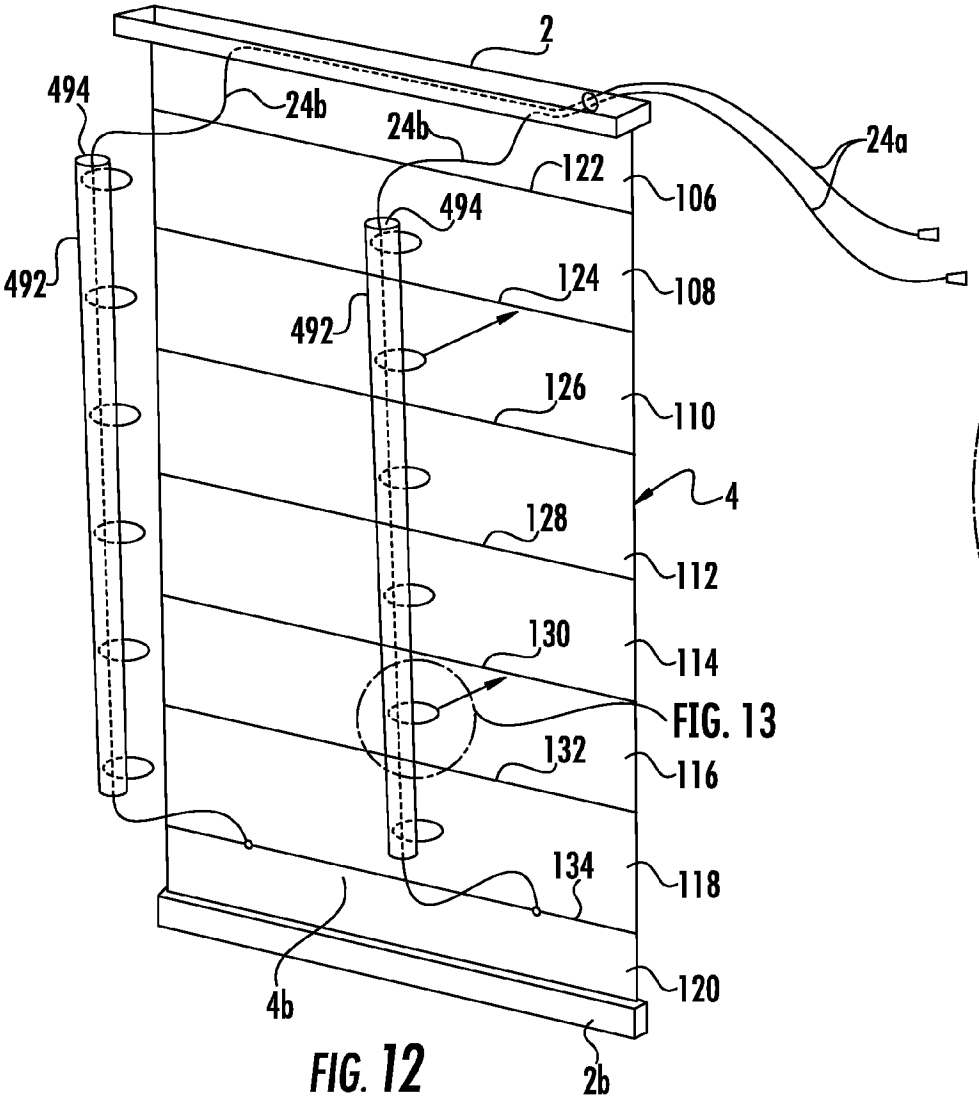
FIG. 12 is a partially exploded back perspective view of a window covering and an embodiment of the safety mechanism of the invention.
Figure 16:
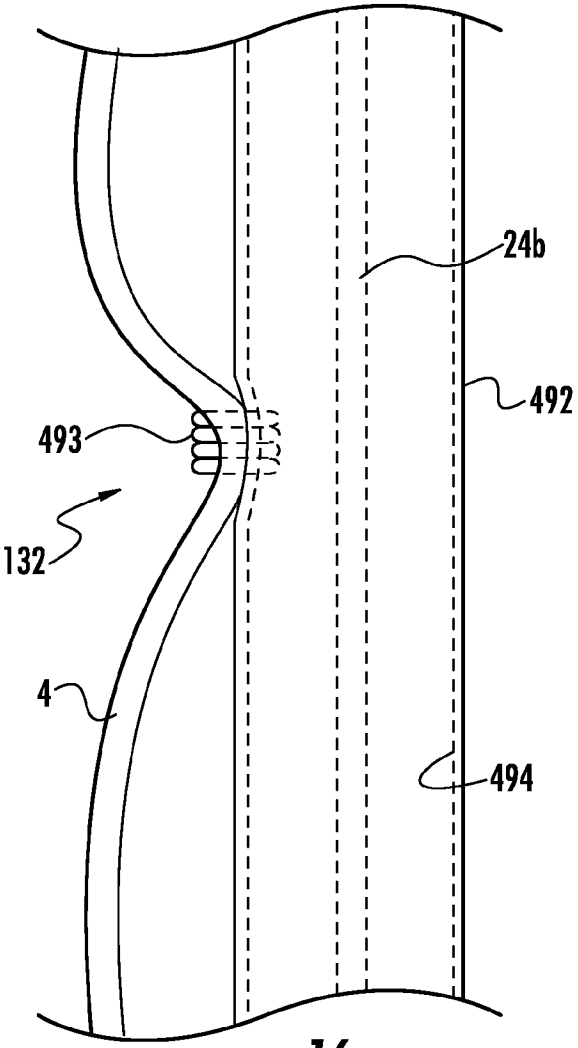
FIG. 16 is a detailed partial side view of another embodiment of the embodiment of FIG. 12 in a lowered position.
Figure 15:
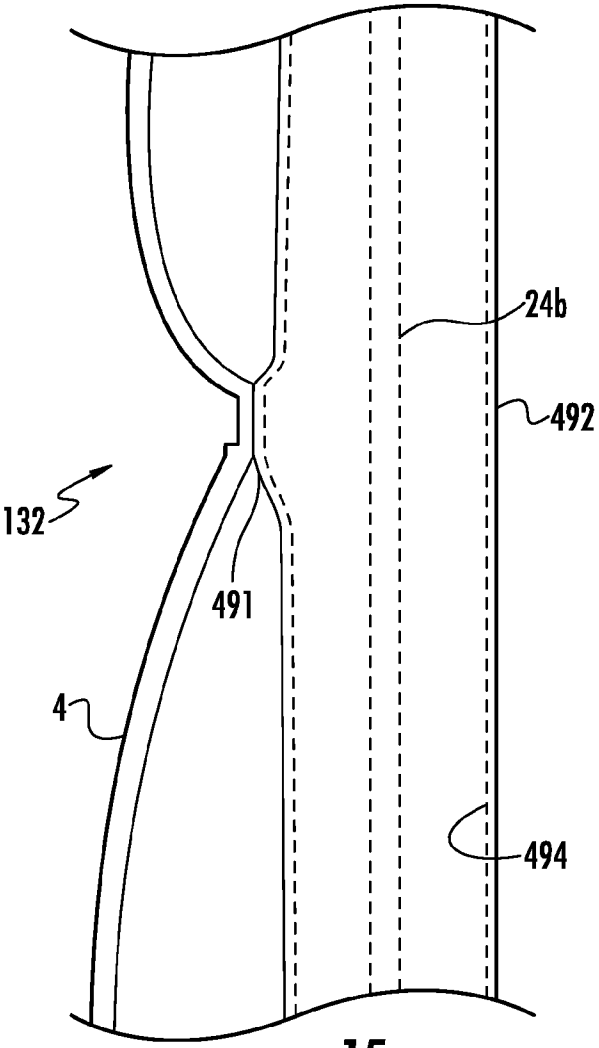
FIG. 15 is a detailed partial side view of another embodiment of the embodiment of FIG. 12 in a lowered position.

The safety cord 330 may be attached to the shade panel 4 by an attachment mechanism 334 at the fixed points. When the lift cord portions 24*b* are raised, the retraction of the lift cords 24*b* collapses the cell structure of the safety cord 330 and causes the shade panel 4 to be raised. The attachment mechanism 334 may be located at desired fold lines 122, 124, 126, 128, 130, 132 and 134 of the shade panel 4. In the embodiment of FIGS. 7 through 10 the attachment mechanism 334 comprises a ring such as a plastic or metal ring 334*a* that engages the safety cord 330 and is secured to the shade panel 4 such as by adhesive, stitching, welding, clips, batten bars, magnets, hook and loop fastener, mechanical fastener, chemical adhesion or the like. While a separate attachment mechanism in the form of ring 334*a* is shown the safety cord 330 may be attached directly to the shade 4 using stitching, adhesive, welding, clips, batten bars, magnets, hook and loop fastener, mechanical fastener, chemical adhesion or the like as shown in the embodiment of FIGS. 15 and 16. Alternatively, the lift cord portions 24*b* may be secured directly to the shade panel 4 by an attachment mechanism that extends through the cell walls of safety cord 330 and is connected to the lift cord portion 24*b* as shown in the embodiment of FIG. 12.

Figure 9:
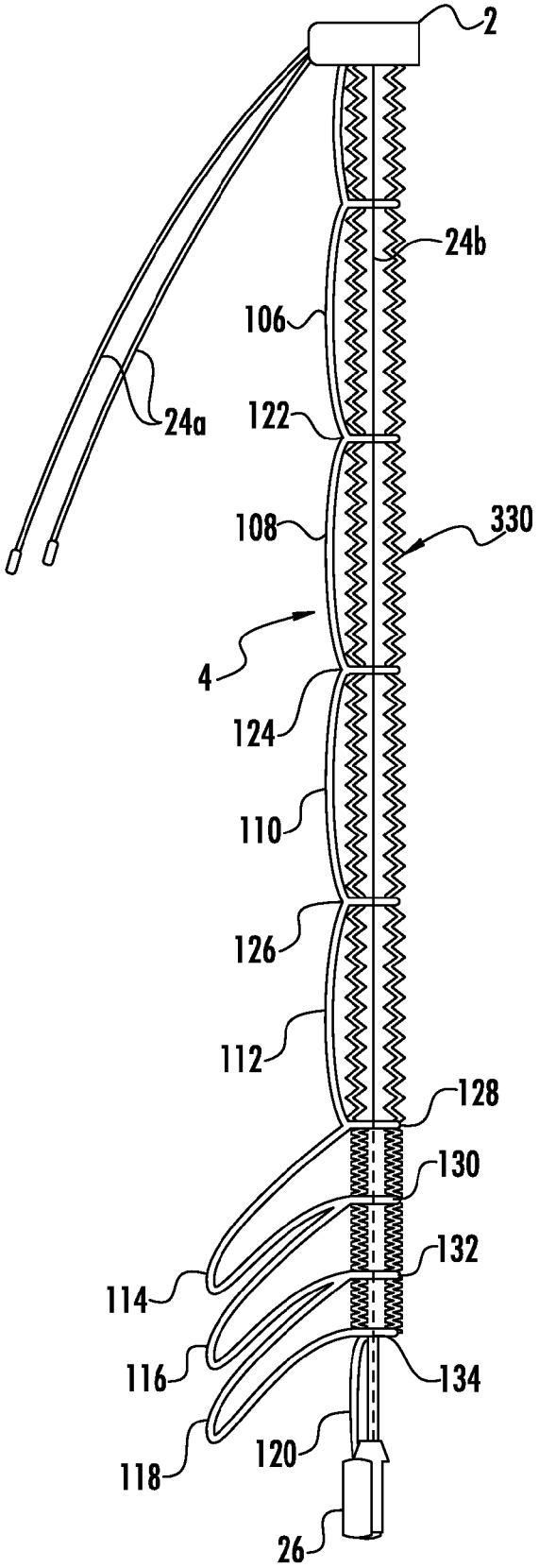
FIG. 9 is a side view of the embodiment of FIG. 7 showing the window covering in a partially raised position.

Referring to FIG. 9, when a user pulls on the pull cord portions 24*a* of the lift cords 24, the lift cord portions 24*b* raise the bottom edge 4*b* of the shade panel and bottom rail 26. The bottom edge 4*b* of the shade 4 rises until it contacts the first attachment between the safety cord 330 and the shade 4 at the joint 132. At this point the first panel 118, between the distal end of lift cord portions 24*b* and joint 132, is folded. As the lift cord portions 24*b* are raised farther the first panel 118 of the shade panel 4, because of its contact with the attachment between the safety element 330 and the shade 4 at joint 132, raises joint 132 until the panel 116 engages the connection between the safety element 330 and the shade 4 at the joint 130. At this point panel 118 and panel 116 are both raised and are both folded. This process may continue until the shade panel 4 is completely raised and all of the panels 106, 108, 110, 112, 114, 116, 118 are folded. As the bottom of the shade panel 4 is lifted the sections of the safety cord 330 between the fold lines 122, 124, 126, 128, 130, 132 and 134 are compressed. Because the safety cord 330 uses a cellular shade structure the cells 332 of the safety cord 330 compress from the expanded cell structure of FIG. 8 to the collapsed cell structure of FIG. 10 in the same manner as the cells of a retracted cellular shade.

An alternate embodiment of a safety mechanism is shown in FIG. 5. The window covering comprises a head rail 52 supporting a flexible shade panel 54 that is divided into a plurality of panels 56, 58, 60, 62 and 64 connected to one another at a horizontal joints or seams 66, 68, 70 and 72 as previously described. The joints or seams may be formed by sewn seams between adjacent panels, fold lines, separate metal or plastic hinge elements or the like. A lift motor 74 such as a spring motor is located on the head rail 52 for holding the shade 54 in a raised position where the lift cord portions 84*b* are connected from the spring motor to the bottom rail 86 or to the bottom edge 54*b* of shade panel 54. Alternatively the shade panel may be raised and lowered using the pull cords 24*a* as described with reference to FIG. 1.

Hook and loop connectors 90 hold a safety ribbon 92 to the face fabric of the shade panel 54 to cover the lift cords 84*b*. A line of hooks or loops 94 is provided on the shade panel 54 extending along each side of the lift cord portions 84*b*. On the safety ribbon 92 two lines of mating hooks or loops 96 are arranged to connect to the hook or loops 94 such that the lift cord portions 84*b* are trapped between the safety ribbon 92 and shade panel 54 when the hook and loop connectors 90 are attached such that the lift cords 84*b* are isolated from the user. The high shear strength of the hook and loop connectors 90 makes it difficult for the ribbons 92 to be pulled from the face fabric of the shade panel 54 to prevent unwanted access to the lift cords 84*b*. The low peel strength of the hook and loop connectors 90 allows the weight of the fabric to pull the shade panel 54 free from the safety ribbons 92 when the lift cords 84*b* are pulled or retracted and the shade panel 54 is raised. When the shade panel 54 is lowered the safety ribbon 92 is reattached to the shade panel 54 using the hook and loop connectors 90 to re-cover the lift cords 84*b*. The safety ribbon 92 forms a shroud around the lift cord portion 24*b* when it is secured to the shade panel 54 that isolates the lift cords 24*b* from the user and prevents access to the lift cord portion.

Figure 11:
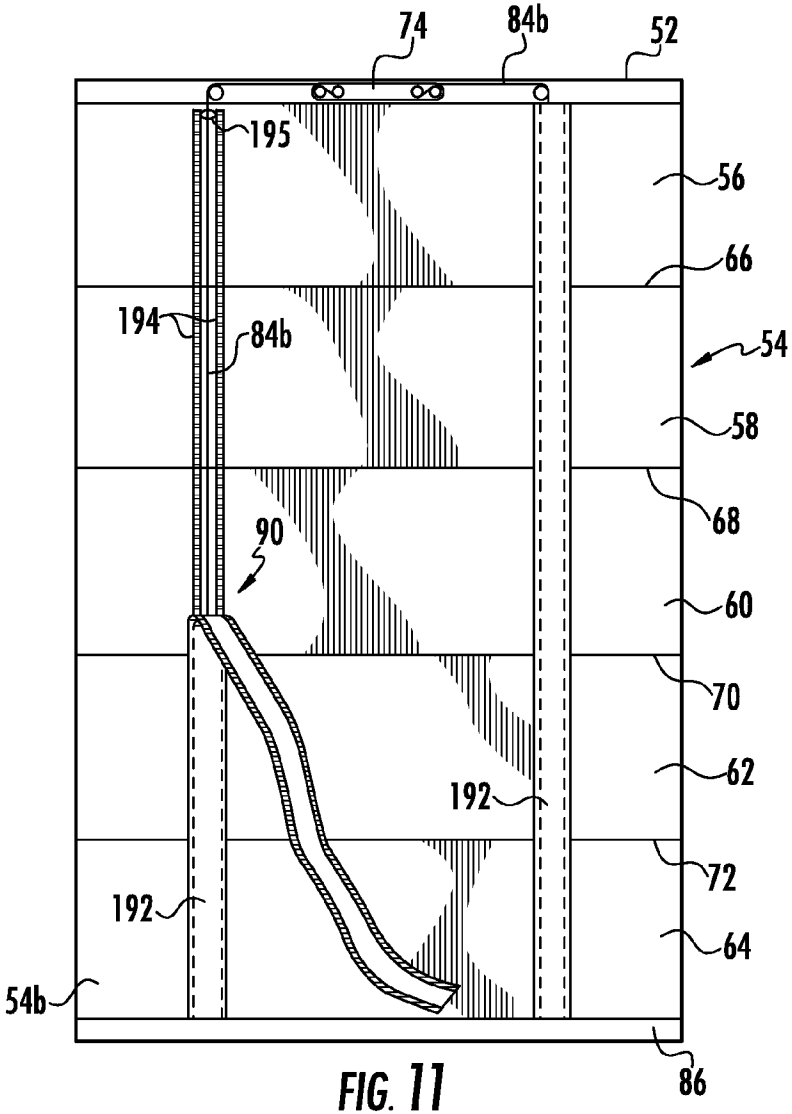
FIG. 11 is a back view of a window covering and another embodiment of the safety mechanism of the invention.
Figure 10:
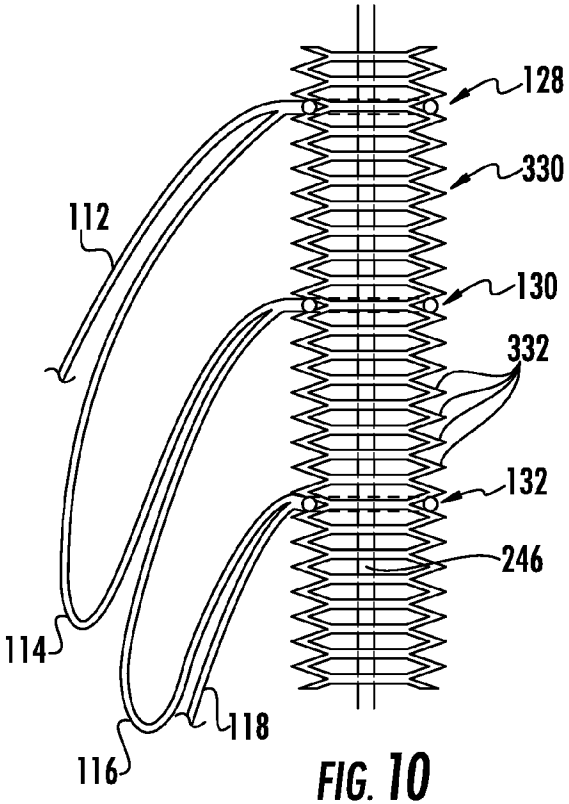
FIG. 10 is a detailed partial side view of the embodiment of FIG. 7 in a raised position.
Figure 13:
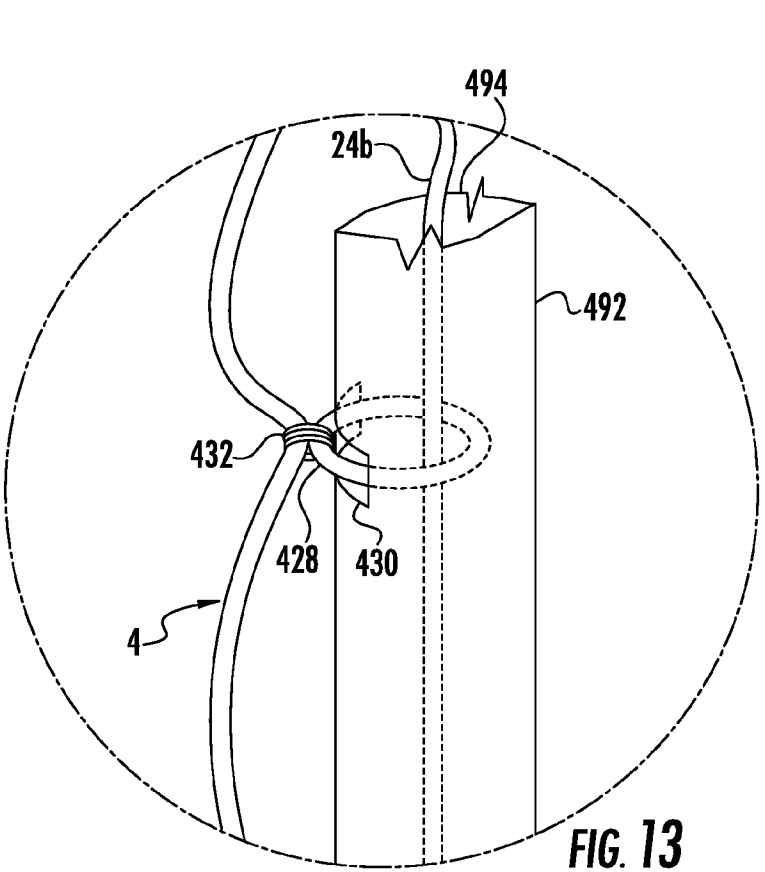
FIG. 13 is a detailed partial side view of the embodiment of FIG. 12 in a lowered position.

An alternate embodiment of a safety mechanism is shown in FIG. 11. The window covering comprises a head rail 52 supporting a flexible shade panel 54 that is divided into a plurality of panels 56, 58, 60, 62 and 64 connected to one another at a horizontal joints or seams 66, 68, 70 and 72 as previously described. The joints or seams may be formed by sewn seams between adjacent panels, fold lines, separate metal or plastic hinge elements such as battens or the like. A lift motor 74 such as a spring motor is located on the head rail 52 for holding the shade 54 in a raised position where the lift cord portions 84*b* are connected from the spring motor to the bottom rail 86 or near or to or near a bottom edge 54*b* of shade panel 54 (for example, at joint or seam 72 or to shade panel 54 above the bottom rail, as described herein). Alternatively the shade panel may be raised and lowered using the pull cords 24*a* as described with reference to FIG. 1.

A safety ribbon 192 is secured to the fabric of the shade panel 54 to cover the lift cords 84*b*. In this embodiment the safety ribbon is permanently secured using an attachment mechanism 194 such as adhesive, stitching, welding, clips, batten bars, magnets, hook and loop fastener, mechanical fastener, chemical adhesion or the like such that the safety ribbon 192 does not detach from the shade panel during normal operation of the window covering. The attachment mechanism 194 may also be woven into the face material during the fabrication process. The attachment mechanism 194 extends along each side of the lift cord portions 84*b* to create a passage through which the lift cords pass during operation of the window covering. The lift cord portions 84*b* are trapped between the safety ribbon 192 and shade panel such that the lift cords 84*b* are isolated from the user. The lift cord portions may engage rings that are attached to the shade panel as previously described with reference to the embodiment of FIG. 1 where the rings are located behind ribbon 192. The safety ribbon 192 forms a shroud around the lift cord portion 24*b* that completely or substantially completely isolates the lift cords 24*b* from the user and prevents access to the lift cord portion.

A method of making a safety device for a window covering comprises providing a head rail as previously described (block 601). A shade panel is suspended from the head rail where the shade panel has a top edge and a bottom edge (block 602). A safety cord is extended from adjacent to the top edge of the shade panel to adjacent the bottom edge of the shade panel where the safety cord comprises a plurality of closely spaced loops (block 603). A lift cord is extended between the head rail and the bottom of the shade panel and is inserted through the plurality of loops (block 604). The lift cord is used to raise and lower the shade panel. The safety cord is attached to the shade panel at a plurality of fixed points between the top edge and the bottom edge to limit the distance the safety cord may be moved away from the shade panel (block 605). As previously described the safety cord may be attached at the seams and may be attached to the rings through which the lift cords pass.

An alternate embodiment of a safety mechanism is shown in FIGS. 12 through 16 where like reference numerals are used to identify like components previously described with reference to the embodiment of FIGS. 1 through 4. The window covering comprises a head rail 2 supporting a flexible shade panel 4 that is divided into a plurality of panels 106, 108, 110, 112, 114, 116, 118 and 120 connected to one another at a horizontal joints or seams 122, 124, 126, 128, 130, 132 and 134 as previously described. The joints or seams may be formed by sewn seams between adjacent panels, fold lines, separate metal or plastic hinge elements such as batten bars or the like. In some embodiments the shade panel 4 may be formed of a single panel that is adapted to fold at a plurality of folds or of a plurality of separate panels connected together at the joints or seams. The lift cord portions 24*b* are operatively connected to the pull cord portions 24*a* and the ends of the lift cord portions 24*b* are connected to the bottom rail 26 or at or near to a bottom edge 4*b* of shade panel 4. The shade panel 4 may be raised and lowered using the pull cords 24*a* as described with reference to FIG. 1. Alternatively, a lift motor 74 such as a spring motor may be located on the head rail 2 for holding the shade 4 in a raised position where the lift cord portions 24*b* are connected from the spring motor 74 to the bottom rail 26 or near or to a bottom edge 4*b* of shade panel 4 as shown in FIG. 5.

In the embodiment of FIGS. 12 through 16 a separate tube 492 is used as the shroud to completely enclose each of the lift cord portions 24*b*. The tube 492 defines a passage 494 that freely receives the lift cord portion 24*b* such that the lift cord portion 24*b* may freely move along the length of the tube 492. The tube 492 may have a cross-sectional shape including circular, oval, rectangular, polygonal, irregular or the like. The tube 492 may be made of any relatively strong collapsible material such as fabric, rubber, plastic, elastomer, paper, or the like provided that the tube 492 may collapse when the shade 4 is raised and will not tear or be damaged during normal use of the window covering. Further, while in the illustrated embodiment the material of the tube 492 is selected to be collapsible the tube may be made of a more rigid material and use a mechanical structure to allow collapsing of the tube. For example, the tube 492 may be made of telescoping rigid plastic sections.

The lift cord portions 24*b* may pass through rings 428 that are attached to the shade panel 4 at fixed points as previously described with reference to the embodiment of FIG. 1. The rings 428 may be attached to the shade panel 4 at the joints or fold lines 122, 124, 126, 128, 130, 132 and 134 by attachment mechanism 432. The rings 428 are inserted through apertures 430 in tube 492 such that the lift cord portions 24*b* engage rings 428 inside of tube 492. The engagement of the rings 428 with the apertures 430 fixes the tube 492 to the shade panel 4 at the fixed points. The lift cord 24*b* passes through the ring 428 as previously described with reference to the embodiment of FIGS. 1 through 4. Alternatively, the rings may be omitted and the tube 492 may be directly attached to the shade panel 4 at the joints or fold lines 122, 124, 126, 128, 130, 132 and 134, as shown in FIGS. 15 and 16, such that the attachment between the tube 492 and the shade panel 4 creates the proper folding of the shade. FIG. 15 shows the tube 492 attached directly to the shade panel 4 by adhesive, sonic welding or thermal welding 491 and FIG. 16 shows the tube 492 attached directly to the shade panel 4 by stitching 493. The tube 492 forms a shroud around the lift cord portion 24*b* that limits access to the lift cord portion and that isolates the lift cords 24*b* from the user where the tube 492 completely or substantially shrouds the lift cord portion 24*b*. As described herein, tube 492 may not extend the entire length of the lift cord portion 24*b* (such as leaving a portion exposed at the top and/or bottom of the lift cord portion 24*b*), but still serve to inhibit access to and limit undesired loops from being formed.

Figure 14:
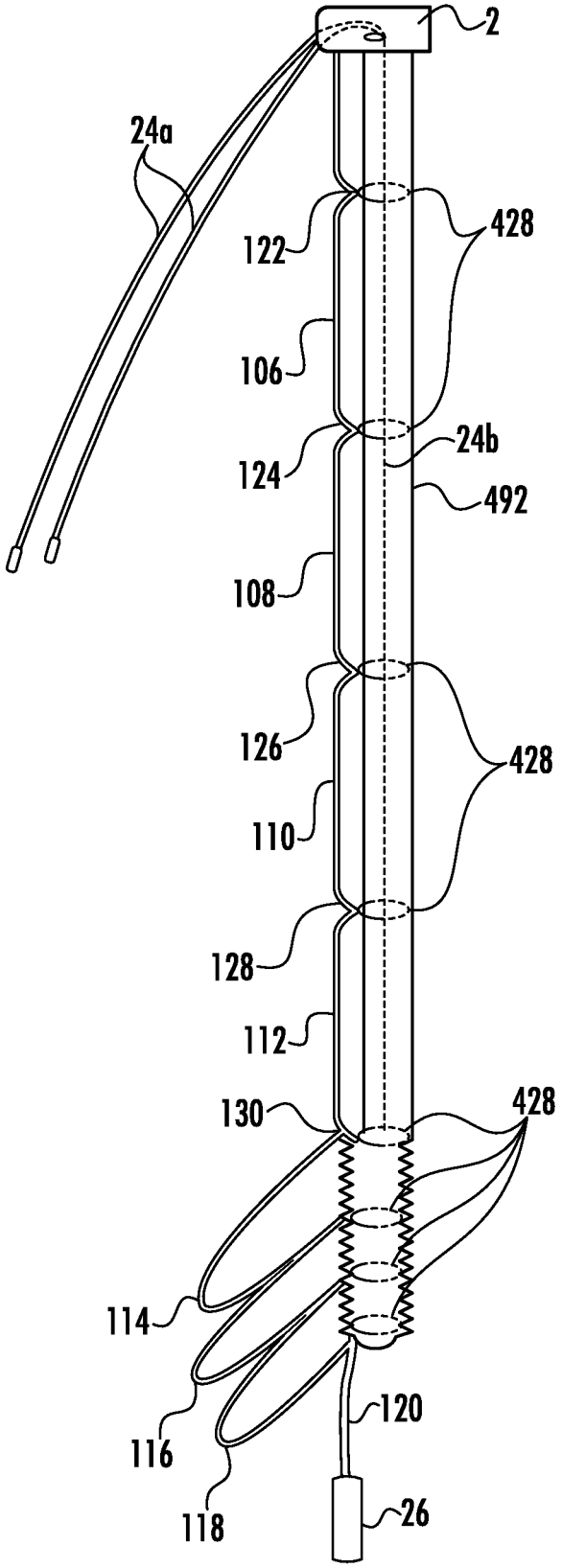
FIG. 14 is a side view of the embodiment of FIG. 12 showing the window covering in a partially raised position.

According to various embodiments, the tube 492 (or any other safety shroud embodiment described herein) may attach to the shade panel at a plurality of locations or fixed points and spaced apart a predetermined distance, where that distance is determined based at least in part on the size of the effective loop that may be formed by the tube 492 (or other safety shroud embodiment), the lift cord, the panel, or any combination thereof. Thus, the lesser the distance between the attachment points of the tube 492 (or other safety shroud embodiment) the smaller the loop size that can possibly be formed (and vice versa). According to one embodiment, it may be determined that approximately 9 inches (less or greater in other embodiments) may be the maximum distance between the tube 492 (or other safety shroud embodiment) attachment locations or fixed points to the shade panel 4. Referring to FIG. 14, when a user pulls on the pull cord portions 24*a* of the lift cords 24, the lift cord portions 24*b* raise the bottom edge 4*b* of the shade panel and bottom rail 26. The bottom edge 4*b* of the shade panel 4 rises until it engages the attachment between the tube 492 and the shade panel 4 at the joint 132. At this point the first panel 118, between the distal end of lift cord portions 24*b* and joint 132, is folded. As the lift cords 24 are raised further the bottom edge 4*b* of the shade panel 4 raises joint 132 until the bottom of the panel 116 engages the attachment between the tube 492 and the shade panel 4 at joint 130. At this point panel 118 and panel 116 are both raised and are both folded. This process may continue until the shade panel 4 is completely raised and all of the panels 106, 108, 110, 112, 114, 116, 118 are folded. As the bottom of the shade panel 4 is lifted the sections of the safety tube 492 between the fold lines 122, 124, 126, 128, 130, 132 and 134 are serially compressed. Because the safety tube 492 is compressible the tube 492 compresses from the expanded configuration of FIG. 13 to the collapsed configuration as shown at the bottom of FIG. 14.

Figure 17:
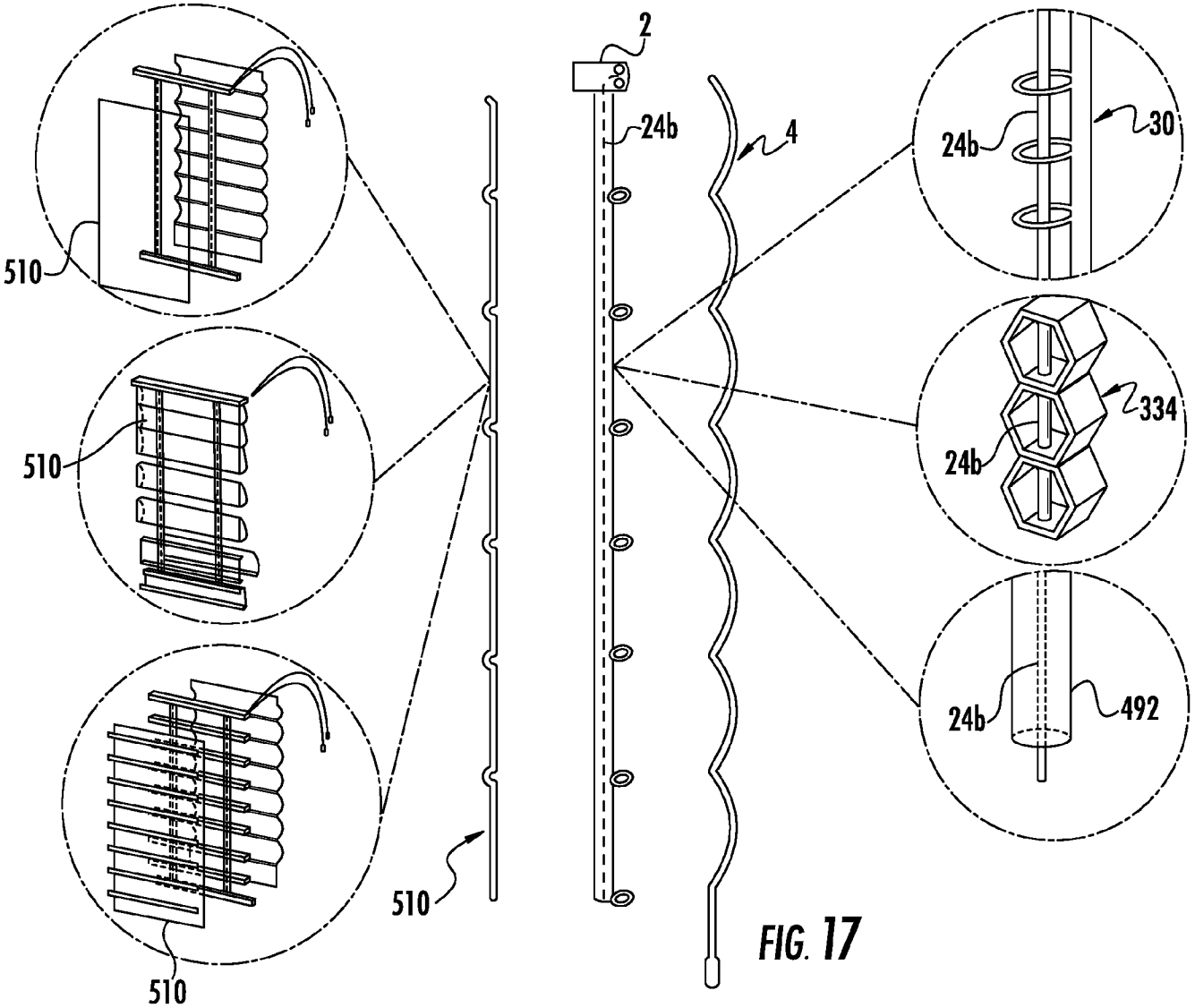
FIG. 17 is a side view of a window covering and an embodiment of the safety mechanism of the invention.

A further embodiment of the safety mechanism of the invention is shown in FIG. 17. In this embodiment a back panel 510 is used as the shroud to cover the lift cords 24*b* and safety mechanisms and may be used with any of the safety mechanisms described above. The back panel 510 preferably covers the lift cord portions 24*b* and the safety mechanism and in one preferred embodiment the back panel 510 extends for substantially the entire height and width of shade panel 4 although it may extend for less than the entire width and height of the shade panel 4. To the extent a safety mechanism is used that does not extend completely between the head rail 2 and the bottom of the shade, the back panel 510 may also extend less than the entire height of the shade panel 4 provided it covers the safety mechanism. The back panel 510 may be applied to the shade panel 4 in a variety of ways and may have a variety of constructions as will hereinafter be described. The back panel 510 covers the lift cords and safety mechanism to create a cleaner appearance. The back panel 510 forms a shroud around the lift cord portion 24*b* and any of the safety mechanisms that isolates the lift cords 24*b* from the user and prevents or significantly limits access to the lift cord portion and further limits the effective size of any cord loop that may be formed to the extent a loop may be formed at all.

Figure 18:
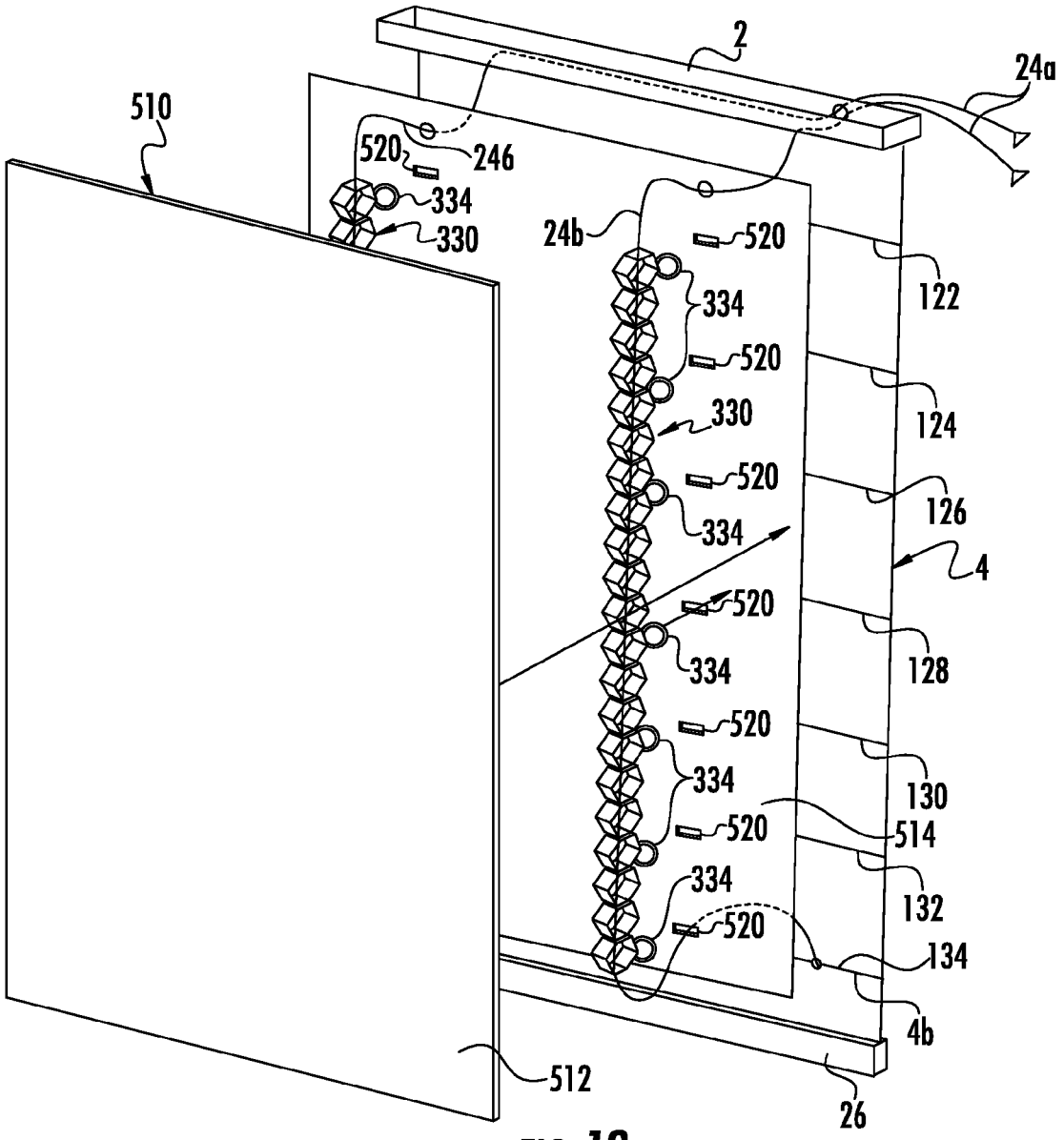
FIG. 18 is a partially exploded back perspective view of a window covering and an embodiment of the safety mechanism of the invention.
Figure 20:
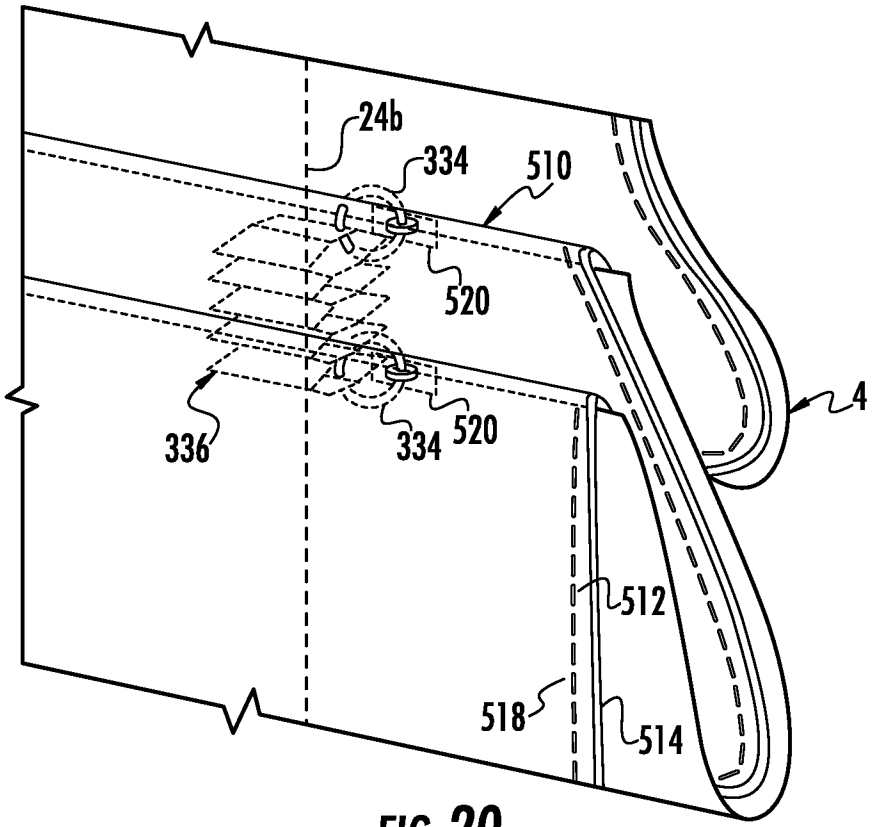
FIG. 20 is a partial perspective view of the embodiment of FIG. 18 showing the window covering in a raised position.
Figure 19:
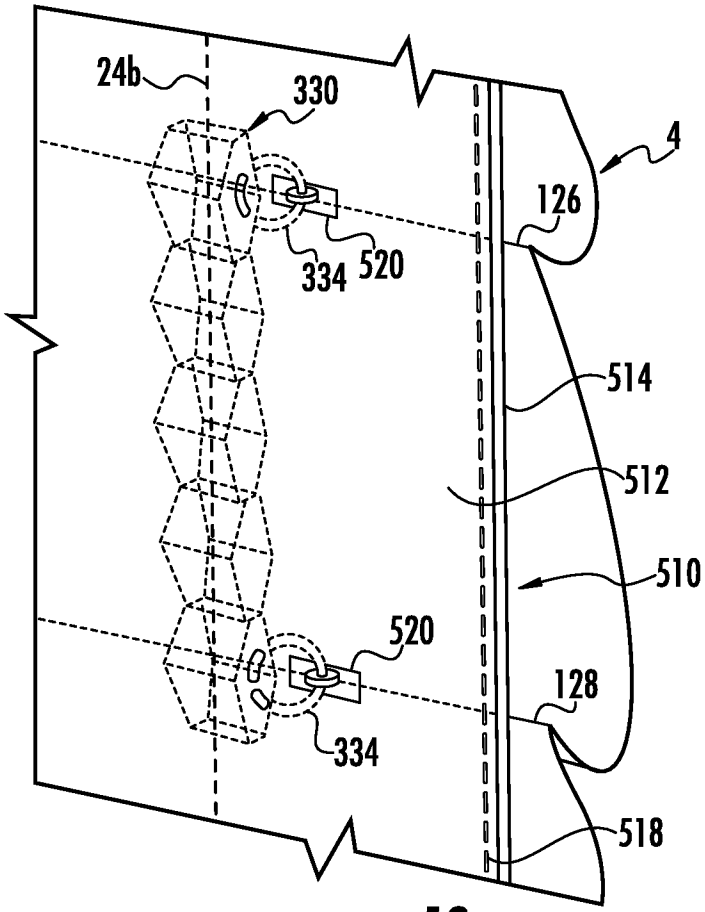
FIG. 19 is a partial perspective view of the embodiment of FIG. 18 showing the window covering in a lowered position.

Referring to FIGS. 18 through 20 one embodiment for the back panel 510 is shown where the back panel 510 comprises a first sheet of material forming a back encasing panel 512 and a second sheet of material forming a front encasing panel 514. The sheets of material 512 and 514 may be made of any flexible material such as a woven or non-woven fabric, plastic or the like that may fold as the shade panel 4 is raised and lowered. The lift cord portions 24*b* and the safety mechanisms 330 are located between the back encasing panel 512 and the front encasing panel 514. The front encasing panel 514 may be attached to back encasing panel 512 around the full perimeter of the panels such that access to the lift cord portions 24*b* and the safety mechanisms are completely enclosed by the back panel 510. The back panel 510 forms a shroud around the lift cord portion 24*b* and any of the safety mechanisms that completely isolates the lift cords 24*b* from the user and prevents access to the lift cord portion regardless of which safety mechanism is used.

The front encasing panel 514 may be attached to back encasing panel 512 by an attachment mechanism 518 such as stitching, adhesive, welding, clips, batten bars, magnets, hook and loop fastener, mechanical fastener, chemical adhesion or the like. The front encasing panel 514 is provided with a plurality of apertures 520 that allow the attachment mechanisms, such as rings 334 or 428, adhesive or welds 491, stitching 493 or the like to extend through the front encasing panel 514 and be connected to the shade panel 4 at the fixed points as previously described. In one embodiment the attachment mechanisms are aligned with the fold lines 122, 124, 126, 128, 130, 132 and 134 of the shade panel 4. While the back panel is shown with safety mechanism 330 the back panel may be used with any of the safety mechanisms described herein, such as, but not limited to, those generally described with reference to FIGS. 1, 7 and 12.

Figure 22:
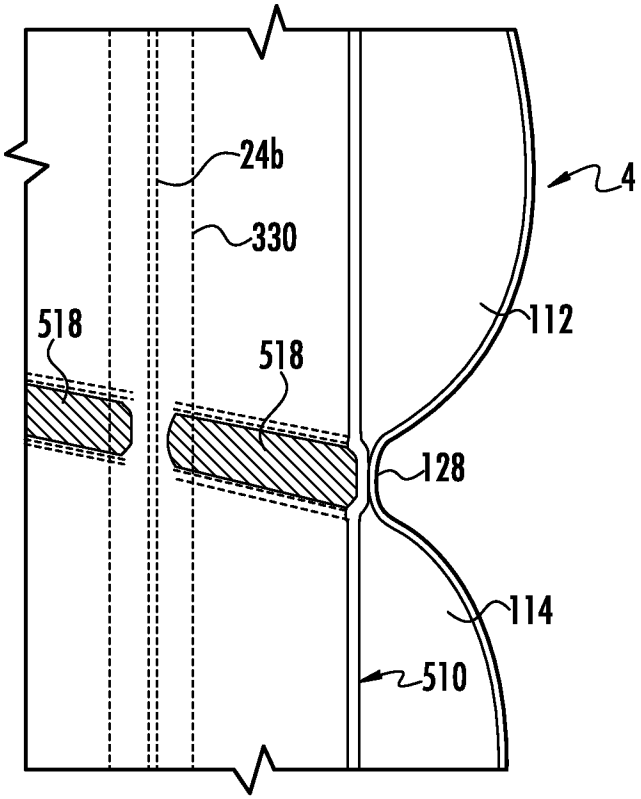
FIG. 22 is a partial perspective view of the embodiment of FIG. 21.
Figure 21:
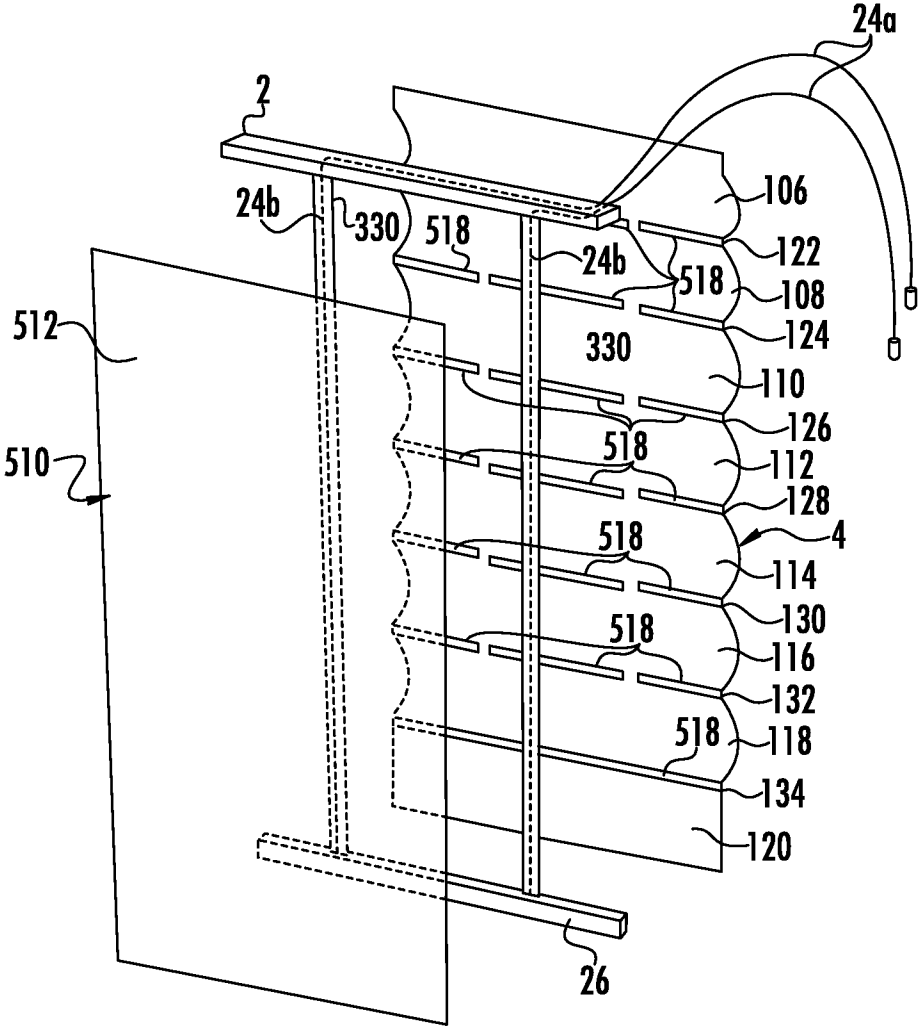
FIG. 21 is a partially exploded back perspective view of a window covering and an embodiment of the safety mechanism of the invention.

Referring to FIGS. 21 and 22 one embodiment for the back panel 510 is shown where the back panel 510 comprises a single sheet of material 512. The sheet of material 512 may be made of any flexible material such as a woven or non-woven fabric, plastic or the like that may fold as the shade panel 4 is raised and lowered. The lift cord portions 24*b* and the safety mechanisms 330 are located between the back panel 510 and the shade panel 4. The back panel 510 may be attached to the shade panel 4 by an attachment mechanism 518 such as stitching, adhesive, welding, clips, batten bars, magnets, hook and loop fastener, mechanical fastener, chemical adhesion or the like. The attachment mechanism extends along the seams 122, 124, 126, 128, 130 132 and 134 between the panels 106, 108, 110, 112, 114, 116, 118 and 120, although in some embodiments, the back panel 510 is not secured to the shade panel 4 along at least the side edges of the shade panel. Gaps 600 are formed along the seams 122, 124, 126, 128, 130 132 and 134 where the attachment mechanism 518 does not connect the shade panel 4 to the back panel 510 to form passages for receiving the lift cord portions 24*b* and the safety mechanism 330. The gaps 600 create interior facing cord guides where the lift cord portions 24*b* extend through the interior facing cord guides. While the back panel is shown with safety mechanism 330 the back panel may be used with any of the safety mechanisms described herein, such as, but not limited to, those generally described with reference to FIGS. 1, 7 and 12. In this embodiment the back panel 510 forms a shroud around the lift cord portion 24*b* and any of the safety mechanisms that at least partially isolates the lift cords 24*b* from the user and limits access to the lift cord portion.

Figure 24:
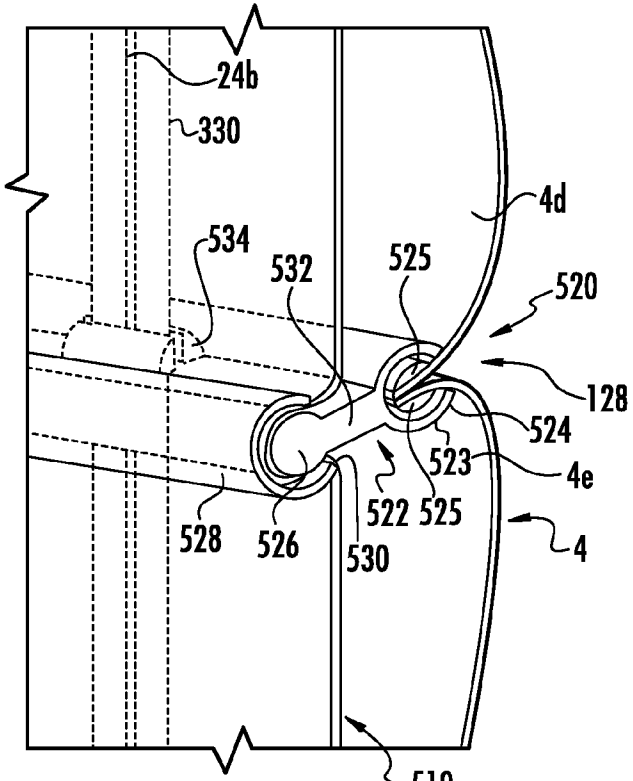
FIG. 24 is a partial perspective view of the embodiment of FIG. 23.
Figure 23:
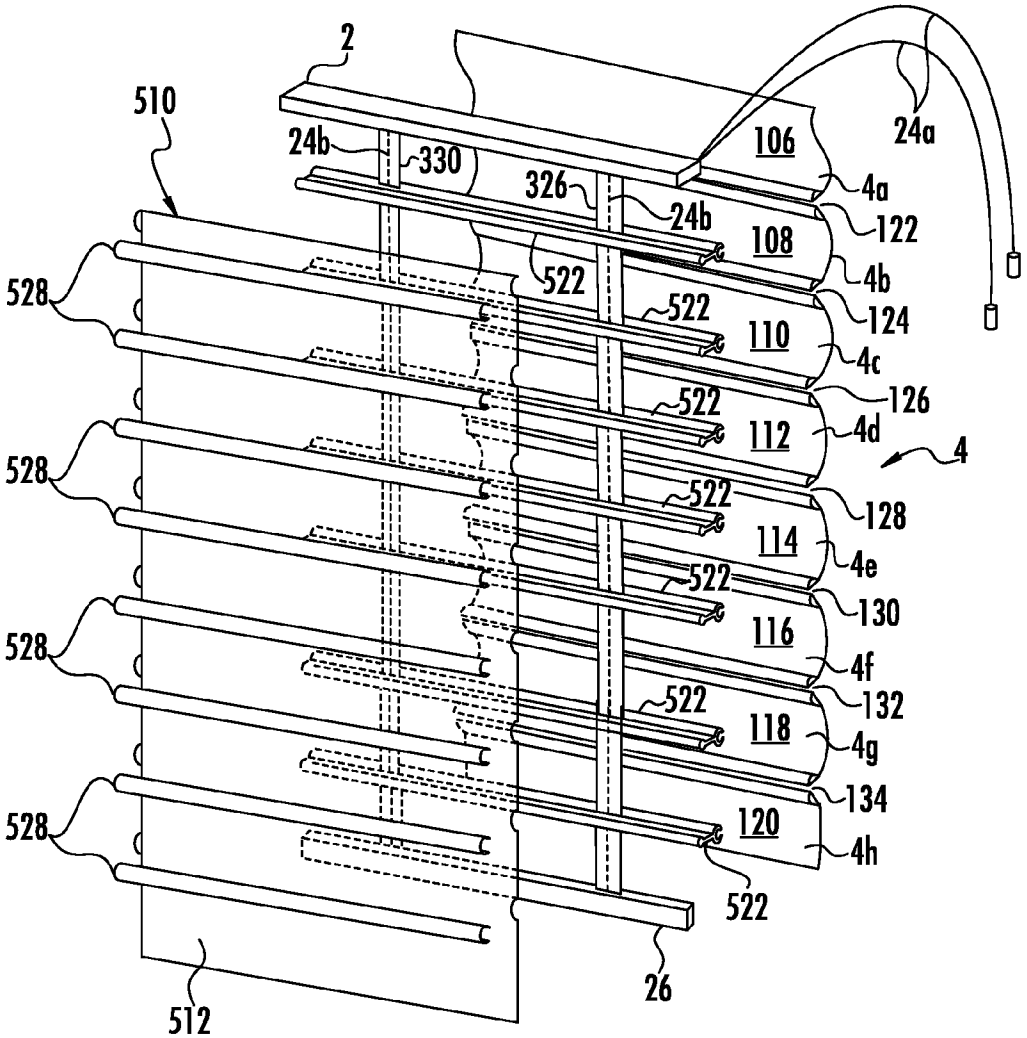
FIG. 23 is a partially exploded back perspective view of a window covering and an embodiment of the safety mechanism of the invention.

Referring to FIGS. 23 and 24 another embodiment for the back panel 510 is shown where the back panel 510 is formed of a sheet of material 512 and the shade panel 4 is formed of a plurality of individual strips of material 4*a*-4*h*. The lift cords 24*b* extend from the head rail 2 to a point at or near the bottom of the shade 4 and the safety mechanisms 330 extend from a point at or near the head rail to a point at or near the bottom of the lift cords as previously described.

A plurality of battens 520 are used to connect the back panel 510 to the front strips of material 4*a*-4*h*. The front strips of material 4*a*-4*h* define the shade panels 106, 108, 110, 112, 114, 116, 118 and 120 and the battens 520 define the fold seams 122, 124, 126, 128, 130 132 and 134. The safety mechanisms 330 extend through the battens 520 and are connected to the shade panel 4 at fixed points via the battens 520. In the illustrated embodiment the fixed points are the fold seams 122, 124, 126, 128, 130 132 and 134. The battens 520 comprise a batten bar 522 that extends for approximately the width of the shade panel 4 and back panel 510. The batten bar may be made of wood, metal, plastic or other rigid material. The batten bar defines a slotted receptacle 523 along the front side thereof that receives the adjacent edges of two adjacent strips 4*a*-4*h*. The edges of the strips may be formed with raised protrusions 525 such as metal, wood or plastic half round members that are forced into the slot 524 of receptacle 523. The receptacle 523 may deform to receive and retain the edges of the strips 4*a*-4*h*. The back side of the batten bars 522 are formed with rounded protrusions 526 over which the material of the back panel 510 is draped. A slotted retaining member 528 fits over the material of back panel 510 and the rounded protrusion 526 to hold the back panel 510 on the batten bar 522. The retaining member 528 may deform to receive and retain the material of back panel 510 and the rounded protrusion 526 in slot 530. A center flange 532 connects slotted receptacle 523 and the rounded protrusion 526 and defines a hole or aperture 534 through which the safety mechanism 330 and the lift cord portion 24*b* extend. The holes or apertures 534 create interior facing cord guides where the lift cord portions 24*b* extend through the interior facing cord guides. The safety mechanism 330 is attached to the batten bars 522 by stitching, adhesive, welding, clips, batten bars, magnets, hook and loop fastener, mechanical fastener, chemical adhesion, interference fit or the like. While the back panel 510 is shown with safety mechanism 330 the back panel may be used with any of the safety mechanisms described herein, such as, but not limited to, those generally described with reference to FIGS. 1, 7 and 12. In this embodiment the back panel 510 forms a shroud around the lift cord portion 24*b* and any of the safety mechanisms that at least partially isolates the lift cords 24*b* from the user and limits access to the lift cord portion.

Figure 26:
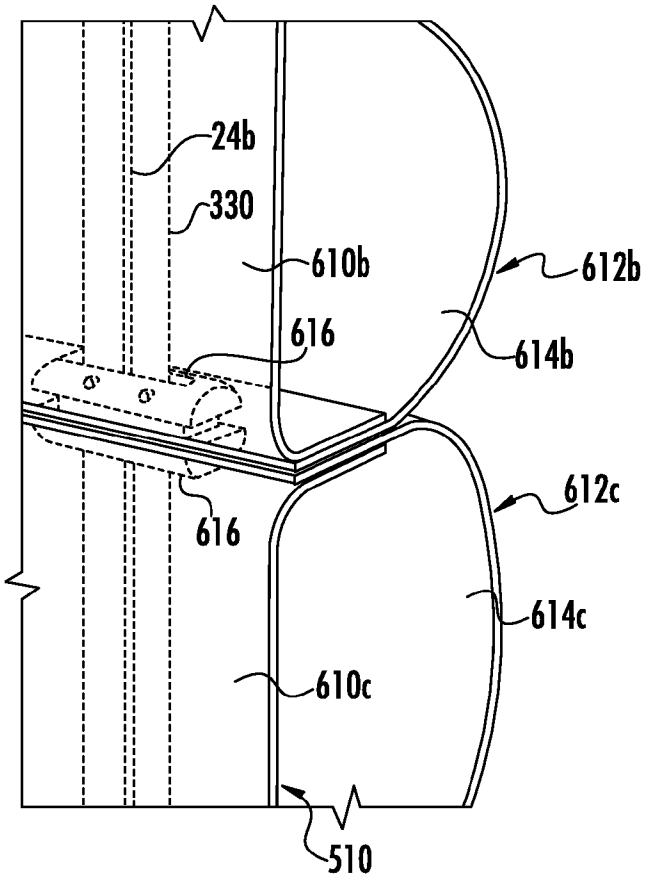
FIG. 26 is a partial perspective view of the embodiment of FIG. 25.
Figure 25:
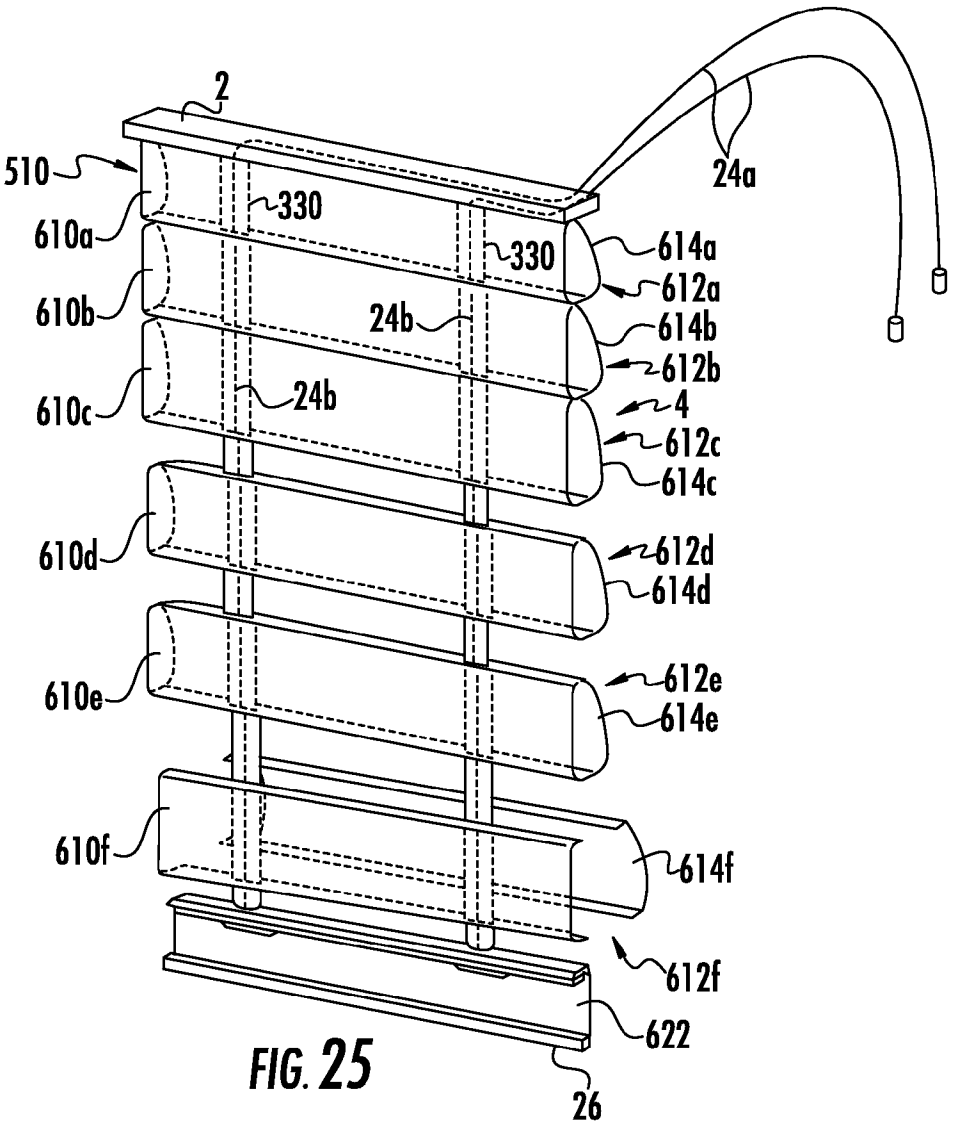
FIG. 25 is a partially exploded back perspective view of a window covering and an embodiment of the safety mechanism of the invention.

Referring to FIGS. 25 and 26 another embodiment for creating the back panel 510 is shown where the back panel 510 is formed of a plurality of individual strips of material 610*a-f* and the front shade 4 is formed of a plurality of individual strips of material 614*a-f*. Each of the front strips 614*a-f* are connected to each of the back strips 610*a-f* to form large cells 612*a-f* where the cells are connected to one another along the fold lines or seams. The front strips 614*a-f* may be joined to the back strips 610*a-f* using any suitable attachment mechanism including stitching, adhesive, welding, clips, batten bars, magnets, hook and loop fastener, mechanical fastener, chemical adhesion or the like. The horizontal top and bottom edges of the front and back strips are secured to one another and the adjacent cells 612*a-f* are joined to one another along the top and bottom edges thereof as shown in FIG. 26. The adjacent cells 612*a-f* may be joined to one another using any suitable attachment mechanism including stitching, adhesive, welding, clips, batten bars, magnets, hook and loop fastener, mechanical fastener, chemical adhesion or the like. The front strips 614*a-f* are dimensioned and shaped such that from the front of the window covering the window may have the appearance of a Roman shade. The back strips 610*a-f* are dimensioned and shaped such that from the back of the window covering has the appearance of a relatively flat surface. The lift cord portions 24*b* and safety mechanisms 330 are inserted through apertures 616 formed along the top edge and bottom edge of the cells 612*a-f* such that the lift cords and safety mechanisms extend from the top rail to or near the bottom of the shade. The apertures 616 create interior facing cord guides where the lift cord portions 24*b* extend through the interior facing cord guides. The safety mechanism 330 is connected to the cells 612*a-f* at fixed points that are preferably the top and bottom edges of cells 612*a-f* by an attachment mechanism such as stitching, adhesive, welding, clips, batten bars, magnets, hook and loop fastener, mechanical fastener, chemical adhesion or the like. The bottom edge of the shade panel 4 may be finished with a panel 622 that simulates the bottom unfolded edge of a Roman shade. While the back panel 510 is shown with safety mechanism 330, the back panel may be used with any of the safety mechanisms described herein, such as, but not limited to, those generally described with reference to FIGS. 1, 7 and 12. In this embodiment the back panel 510 forms a shroud around the lift cord portion 24*b* and any of the safety mechanisms that at least partially isolates the lift cords 24*b* from the user and limits access to the lift cord portion.

The back panel 510 limits or prevents access to the lift cords. In some embodiments the lift cords are completely isolated from the user. In other embodiments the lift cords may only be accessed through the opening between the shade 4 and the back panel 510 at the side edges of the window covering such that a person would have to reach between the shade and the back panel to gain access to the lift cords. Moreover, if a person did access the lift cords in such a manner the material of the back panel between the lift cords and the side edge of the back panel limits the length of the lift cord that may be exposed outside of the back panel to further limit the size of a potential loop.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A window covering comprising:

a head rail configured to be mounted to define a front of the window covering and a back of the window covering;

a shade panel having a back side disposed toward the back of the window covering, the shade panel extending from the head rail;

a lift cord extending between the head rail and a point on the shade panel along the back side for raising the shade panel and a pull cord operatively connected to the lift cord to raise the shade panel, the pull cord extending from the head rail toward the front of the window covering relative to the shade panel;

a collapsible tube defining a passage with a central axis transverse to the head rail, the collapsible tube forming a shroud that surrounds a portion of the lift cord; and a back panel extending along the back side and disposed toward the back of the window covering with respect to the shade panel, the back panel comprising a front encasing panel having a first edge and a second edge, the first edge and the second edge extending from the head rail to a bottom rail, and a back encasing panel having a third edge and a fourth edge extending from the head rail to the bottom rail, the back encasing panel defining an interior therein, wherein the lift cord extends through the interior defined between the front encasing panel and back encasing panel, the front encasing panel being connected to the back encasing panel along the entire lengths of the first edge and the third edge between the head rail and the bottom rail, and further being connected along the entire lengths of the second edge and the fourth edge between the head rail and the bottom rail.

2. The window covering of claim 1, wherein the back panel is operably connected to the shade panel at a plurality of points by a plurality of rings.

3. The window covering of claim 2, wherein at least a portion of the plurality of rings extend through the front encasing panel and into the interior, wherein the lift cord extends through the at least a portion of the plurality of rings.

4. The window covering of claim 1, wherein at least one of the front encasing panel or the back encasing panel comprise an interior facing cord guide, wherein the lift cord extends through the interior facing cord guide.

5. The window covering of claim 1, wherein the lift cord comprises a first lift cord and a second lift cord, and wherein both the first lift cord and the second lift cord extend along at least a partial length of the shade panel and through the interior defined between the front encasing panel and back encasing panel.

6. The window covering of claim 1, wherein the collapsible tube is operably connected to the shade panel at a plurality of points along the length of the shade panel and positioned between the back panel and the shade panel.

7. The window covering of claim 1, wherein the back panel comprises a front encasing panel and a back encasing panel defining an interior therein, wherein at least a portion of the lift cord extends through the interior defined between the front encasing panel and back encasing panel, the back panel being operably connected to the shade panel at a plurality of points along the back panel.

8. The window covering of claim 1, wherein the front encasing panel comprises a first perimeter edge and the back encasing panel comprises a second perimeter edge, the front encasing panel being secured to the back encasing panel along at least a portion of the first perimeter edge and the second perimeter edge.

9. The window covering of claim 1, wherein the back panel extends substantially the width of the shade panel.

10. A window covering comprising:

a head rail configured to be mounted to define a front of the window covering and a back of the window covering;

a shade panel having a back side disposed toward the back of the window covering, the shade panel extending from the head rail;

a bottom rail attached to a bottom edge of the shade panel;

a lift cord extending from the head along the back side for raising the shade panel; and a back panel extending along the back side and disposed toward the back of the window covering with respect to the shade panel, the back panel comprising a front encasing panel having a first edge and a second edge, the first edge and the second edge extending from the head rail to the bottom rail and a back encasing panel having a third edge and a fourth edge extending from the head rail to the bottom rail, the back panel defining an interior between the front encasing panel and the back encasing panel, wherein the lift cord extends through the interior defined between the front encasing panel and back encasing panel, the front encasing panel being connected to the back encasing panel along the entire lengths of the first edge and the third edge between the head rail and the bottom rail and along the entire lengths of the second edge and the fourth edge between the head rail and the bottom rail.

* * * * *